US012630969B2

(12) United States Patent
Kim et al.

(10) Patent No.: US 12,630,969 B2
(45) Date of Patent: May 19, 2026

(54) DRY APPARATUS AND CONTROL METHOD THEREFOR

(71) Applicant: SAMSUNG ELECTRONICS CO., LTD., Suwon-si (KR)

(72) Inventors: Hoyoung Kim, Suwon-si (KR); Taegyoon Noh, Suwon-si (KR); Inbang Song, Suwon-si (KR); Junhoe Choi, Suwon-si (KR); Jeongsu Han, Suwon-si (KR); Jongsoo Hong, Suwon-si (KR); Namgyu Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 465 days.

(21) Appl. No.: 18/201,963

(22) Filed: May 25, 2023

(65) Prior Publication Data

US 2023/0295866 A1 Sep. 21, 2023

Related U.S. Application Data

(63) Continuation of application No. PCT/KR2021/013843, filed on Oct. 8, 2021.

(30) Foreign Application Priority Data

Dec. 1, 2020 (KR) ..... 10-2020-0165938

(51) Int. Cl.
*D06F 58/46* (2020.01)
*D06F 34/05* (2020.01)
(Continued)

(52) U.S. Cl.
CPC ..... *D06F 58/46* (2020.02); *D06F 34/05* (2020.02); *D06F 58/38* (2020.02);
(Continued)

(58) Field of Classification Search
CPC ..... D06F 58/46; D06F 34/05; D06F 58/38; D06F 2103/34; D06F 2103/68; D06F 2105/26
(Continued)

(56) References Cited

U.S. PATENT DOCUMENTS 5,101,575 A * 4/1992 Bashark ..... G01R 31/2825 34/562
6,931,760 B2 * 8/2005 Yang ..... D06F 58/46 34/494
(Continued)

FOREIGN PATENT DOCUMENTS

JP 2018-143646 9/2018
KR 10-0587358 6/2006
(Continued)

OTHER PUBLICATIONS

International Search Report dated Jan. 28, 2022 in International Patent Application No. PCT/KR2021/013843.
(Continued)

*Primary Examiner* — Stephen M Gravini
(74) *Attorney, Agent, or Firm* — STAAS & HALSEY LLP

(57) ABSTRACT

A dryer comprising: a user interface configured to receive input for a drying course; a communication interface; a drum; a hot air supply device to supply hot air to the drum; a sensing device, enabled to self-generate power based on a movement of the sensing device inside the drum while the drum is being rotated and transmits sensing data according to a voltage generated according to the self-power generation to the communication interface; and a processor to control an operation of the hot air supply device on the basis of the input for the drying course received through the user interface, where the control of the operation of the hot wind supplying device by the processor includes determining an
(Continued)

operation time during which the hot air supply device operates to supply the hot air to the drum on the basis of the sensing data.

15 Claims, 20 Drawing Sheets

(51) Int. Cl.
*D06F 58/38* (2020.01)
*D06F 103/34* (2020.01)
*D06F 103/68* (2020.01)
*D06F 105/26* (2020.01)

(52) U.S. Cl.
CPC ..... *D06F 2103/34* (2020.02); *D06F 2103/68* (2020.02); *D06F 2105/26* (2020.02)

(58) Field of Classification Search
USPC ..... 34/491, 595–610
See application file for complete search history.

(56) References Cited

U.S. PATENT DOCUMENTS

| | | | | |
|---|---|---|---|---|
| 7,322,126 | B2 * | 1/2008 | Beaulac | D06F 58/38 34/554 |
| 7,971,371 | B2 * | 7/2011 | Beaulac | D06F 58/38 34/546 |
| 10,801,158 | B2 | 10/2020 | Bang et al. | |
| 10,900,164 | B2 | 1/2021 | Seok et al. | |
| 11,248,334 | B2 * | 2/2022 | Vitali | D06F 58/38 |
| 11,286,610 | B2 * | 3/2022 | Lee | D06F 25/00 |
| 11,535,975 | B2 * | 12/2022 | Jung | H02P 27/085 |
| 2004/0168343 | A1 * | 9/2004 | Park | D06F 34/18 34/606 |
| 2004/0261286 | A1 * | 12/2004 | Green | D06F 58/38 34/527 |
| 2017/0037563 | A1 | 2/2017 | Kulkarni | |
| 2019/0390395 | A1 | 12/2019 | Seok et al. | |
| 2020/0002873 | A1 | 1/2020 | Chae et al. | |
| 2020/0263339 | A1 | 8/2020 | Kim et al. | |
| 2022/0356637 | A1 * | 11/2022 | Noh | D06F 34/10 |
| 2023/0121501 | A1 * | 4/2023 | Choi | D06F 58/38 34/550 |
| 2023/0295866 | A1 * | 9/2023 | Kim | D06F 34/05 34/491 |
| 2023/0349090 | A1 * | 11/2023 | Kim | D06F 34/26 |

FOREIGN PATENT DOCUMENTS

| | | | | |
|---|---|---|---|---|
| KR | 10-0662772 | | 1/2007 | |
| KR | 10-2018-0074402 | | 7/2018 | |
| KR | 10-1939089 | | 1/2019 | |
| KR | 10-1970251 | | 4/2019 | |
| KR | 10-2019-0100116 | | 8/2019 | |
| KR | 10-2019-0101859 | | 9/2019 | |
| KR | 10-2019-0143317 | | 12/2019 | |
| KR | 10-2020-0099831 | | 8/2020 | |
| KR | 10-2022-0000580 | | 1/2022 | |
| KR | 20220076940 | A * | 6/2022 | D06F 58/263 |
| WO | WO 2018/086871 | A1 | 5/2018 | |
| WO | WO-2022119104 | A1 * | 6/2022 | D06F 58/263 |

OTHER PUBLICATIONS

PCT/ISA/237 dated Jan. 28, 2022 in International Patent Application No. PCT/KR2021/013843.
Korean Office Action issued Aug. 19, 2025 for Application No. 10-2020-0165938.
Korean Office Action issued Apr. 9, 2026 for Application No. 10-2020-0165938.

* cited by examiner

FIG. 7
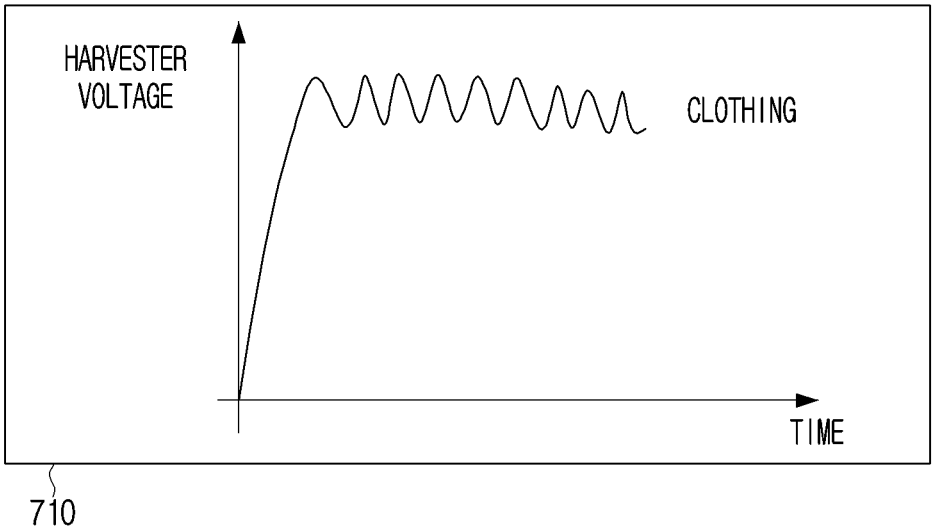
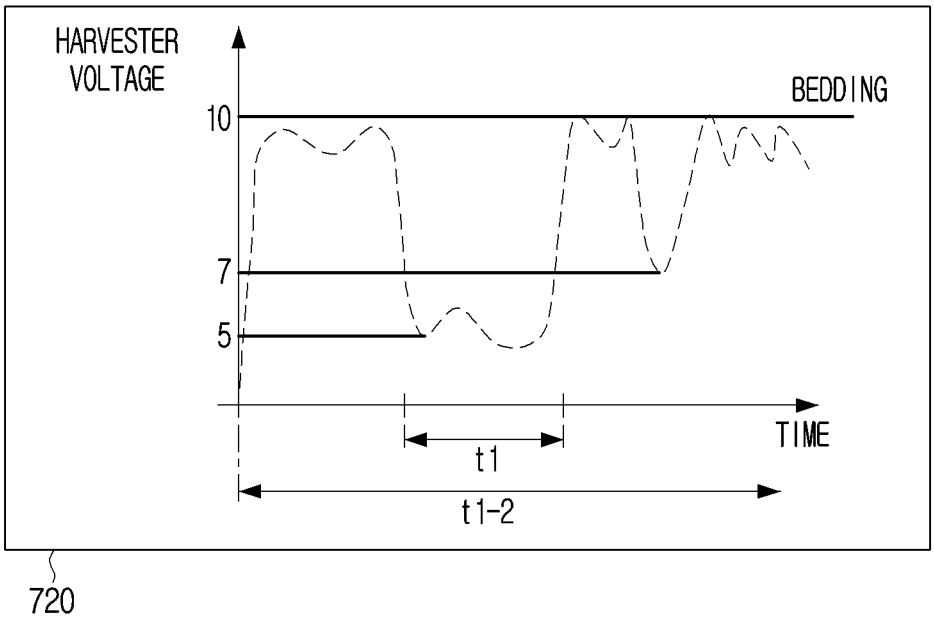

FIG. 16

1610

| VOLTAGE AND RATE CONDITION FOR EACH SECTION/ALL SECTIONS FOR BEDDING DETERMINATION | | | |
|---|---|---|---|
| EACH SECTION | ALL SECTIONS | REFERENCE HARVESTER VOLTAGE | RATE |
| SECTION 1 | T MINUTES | 5.3 [V] | 10% OR MORE |
| SECTION 2 | | | |
| SECTION 3 | | | |
| SECTION 4 | | | |
| SECTION 5 | | | |

1620

| ADDITIONAL DRY TIME ACCORDING TO REFERENCE RATE OF HARVESTER VOLTAGE | | | |
|---|---|---|---|
| CALCULATE VALUE | RATE | ADDITIONAL DRY TIME | GUIDE FOR USER |
| HARVESTER VOLTAGE RATE | 10~20% | +65 MINUTES | NONE |
| | 20~30% | +70 MINUTES | |
| | 30~40% | +75 MINUTES | |
| | 50~70% | +80 MINUTES | "KEEP DRYING AFTER TURNING" |
| | 70~100% | +90 MINUTES | |

1630

| ADDITIONAL DRY TIME ACCORDING TO SURFACE VOLTAGE VALUE OR HUMIDITY VALUE (CONSIDERING PERCENTAGE OF WATER CONTENT) | | | |
|---|---|---|---|
| INITIAL PERCENTAGE OF WATER CONTENT | SURFACE VOLTAGE VALUE | HUMIDITY VALUE | ADDITIONAL DRY TIME |
| LOW PERCENTAGE OF WATER CONTENT | 200~300 | 0~45% RH | +0 MINUTES |
| MODERATE PERCENTAGE OF WATER CONTENT | 100~200 | 45~70% RH | +5 MINUTES |
| HIGH PERCENTAGE OF WATER CONTENT | 0~100 | 70~100% RH | +10 MINUTES |

DRY APPARATUS AND CONTROL METHOD THEREFOR

CROSS-REFERENCE TO RELATED APPLICATION(S)

This application is a continuation application, under 35 U.S.C. § 111(a), of international application No. PCT/KR2021/013843, filed on Oct. 8, 2021, which claims priority under 35 U. S. C. § 119 to Korean Patent Application No. 10-2020-0165938, filed on Dec. 1, 2020, the disclosures of which are incorporated herein by reference in their entirety.

BACKGROUND

Field

Apparatuses and methods consistent with the disclosure relate to a dry apparatus and a control method thereof, and more particularly, to a dry apparatus controlling a dry process based on sensing data received from the outside, and a control method thereof.

Description of the Related Art

A dry apparatus may include several modes to dry various types of subjects to be dried. A user may generally use a standard dry course. However, the user may use a different mode for each type of subject to be dried such as synthetic fiber, wool, delicate clothing, shirt, blanket, or towel. Each mode provides a dry process suitable for each of various types of subjects to be dried by applying different detailed settings of the dry process.

Here, the user needs to directly select a mode, which may be inconvenient. In case that the user misunderstands the type of subject to be dried or selects a wrong mode, the subject to be dried may be damaged during the dry process.

In addition, because a method of measuring the dry degree inside the dry apparatus assumes general clothing (clothing that does not require special care or the like), it is difficult to apply the method to a specific subject to be dried such as bedding.

For example, the inner side and the outer side of a subject to be dried having a large volume and size may be dried at different speeds. For example, the inside of a subject to be dried such as bedding is not dried well because it is frequently rolled in or twisted. Therefore, in order to completely dry bedding, the user needs to select a mode to perform the dry process for a longer period of time compared to general clothing. However, the user needs to directly select the mode, and thus, there is a problem in that the user needs to directly manipulate the dry apparatus at the time of starting the dry process or set an additional dry process again after the dry process is completed.

In case that an additional dry process is performed again after the dry process is completed, the subject to be dried may smell bad, and power may be wasted.

SUMMARY

A dry apparatus according to the present embodiment for achieving the above-described object includes: a user interface configured to receive input for a dry course to be performed; a communication interface; a drum configured to accommodate a subject to be dried; a hot wind supplying device configured to supply hot air to the drum in association with the dry course to dry the subject while the subject is accommodated in drum; a sensing device configured to perform self-power generation based on a movement of the sensing device inside the drum while the drum is being rotated in association with the dry course to dry the subject accommodated in drum and transmit sensing data corresponding to a voltage generated according to the self-power generation to the communication interface; and a processor configured to control an operation of the hot wind supplying device based on the input for the dry course received through the user interface, wherein the control of the operation of the hot wind supplying device by the processor includes determining an operation time during which the hot wind supplying device operates to supply the hot air to the drum based on the sensing data.

The sensing data may include at least one of humidity or temperature.

The sensing device may move along with the subject to be dried accommodated in the drum while the drum is being rotated and the sensing device is connectable to communicate with the communication interface through wireless communication.

The processor may be configured to acquire a voltage variation range through the sensing data and determine the operation time based on the acquired voltage variation range.

The processor may be configured to control a rotating operation of the drum and determine the operation time of the hot wind supplying device based on the sensing data acquired for a certain period of time from a time point at which the drum is controlled to rotate.

The processor may be configured to determine the operation time of the hot wind supplying device as a first time based on the dry course and determine the operation time of the hot wind supplying device as a second time based on the sensing data, and the second time may be greater than the first time.

The processor may be configured to change the operation time of the hot wind supplying device based on humidity or temperature while controlling the operation of the hot wind supplying device according to the operation time of the hot wind supplying device.

The processor may be configured to receive a signal corresponding to a dry degree of the subject to be dried from a dry degree sensor of the sensing device in contact with the subject to be dried accommodated in the drum, the sensing data may include humidity data, and the processor may be configured to determine whether to operate the hot wind supplying device based on the humidity data acquired after a time point that was determined based on the signal transmitted from the dry degree sensor.

The hot wind supplying device may include a heat pump device that heats air by using condensed heat of a refrigerant and a blowing device, and the processor may be configured to control an operation of the heat pump device based on the operation time.

The processor may be configured to control the hot wind supplying device based on setting information corresponding to the voltage, and the setting information corresponding to the voltage may include at least one of a dry time, a dry temperature, a strength of hot wind, or a rotating speed of the drum.

A control method of a dry apparatus according to one or more embodiments of the disclosure includes: controlling a hot wind supplying device to supply hot air to a drum which accommodates a subject to be dried; receiving sensing data corresponding to a voltage generated from a sensing device that performs self-power generation based on a movement of the sensing device inside the drum while the drum is being rotated in association with an input for a dry course to dry the subject accommodated in drum; and controlling an operation of the hot wind supplying device based on the input for the dry course through a user interface of the dry apparatus, wherein in the controlling of the operation of the hot wind supplying device, an operation time during which the hot wind supplying device operates to supply the hot air to the drum is determined based on the sensing data.

The sensing data may include at least one of humidity or temperature.

The sensing device may move along with the subject to be dried accommodated in the drum while the drum is being rotated and the sensing device is connectable to communicate with a communication interface of the dry apparatus through wireless communication.

In the controlling of the operation of the hot wind supplying device, a voltage variation range may be acquired through the sensing data, and the operation time may be determined based on the acquired voltage variation range.

In the controlling of the operation of the hot wind supplying device, a rotating operation of the drum may be controlled, and the operation time may be determined based on the sensing data acquired for a certain period of time from a time point at which the drum is controlled to rotate.

In the controlling of the operation of the hot wind supplying device, the operation time of the hot wind supplying device may be determined as a first time based on the dry course, the operation time of the hot wind supplying device may be determined as a second time based on the sensing data, and the second time may be greater than the first time.

In the controlling of the operation of the hot wind supplying device, the operation time of the hot wind supplying device may be changed based on the humidity or the temperature while controlling the operation of the hot wind supplying device according to the operation time.

The control method may further include receiving a signal corresponding to a dry degree of the subject to be dried from a dry degree sensor of the sensing device in contact with the subject to be dried accommodated in the drum, the sensing data may include humidity data, and in the controlling of the operation of the hot wind supplying device, whether to operate the hot wind supplying device may be determined based on the humidity data acquired after a time point that was determined based on the signal transmitted from the dry degree sensor.

In the controlling of the operation of the hot wind supplying device, an operation of a heat pump device of the hot wind supplying device that heats air by using condensed heat of a refrigerant may be controlled based on the operation time of the hot wind supplying device.

In the controlling of the operation of the hot wind supplying device, the hot wind supplying device may be controlled based on setting information corresponding to the voltage, and the setting information corresponding to the voltage may include at least one of a dry time, a dry temperature, a strength of hot wind, or a rotating speed of the drum.

BRIEF DESCRIPTION OF THE DRAWINGS

The above and other aspects, features, and advantages of certain embodiments of the present disclosure will be more apparent from the following description taken in conjunction with the accompanying drawings, in which:

FIG. 7 is a graph for illustrating a change in harvester voltage according to the plurality of examples and embodiment(s) of the present disclosure.

FIG. 16 is a table for illustrating information used to identify the additional time for the dry process according to an embodiment of the present disclosure.

DETAILED DESCRIPTION

Figure 1:
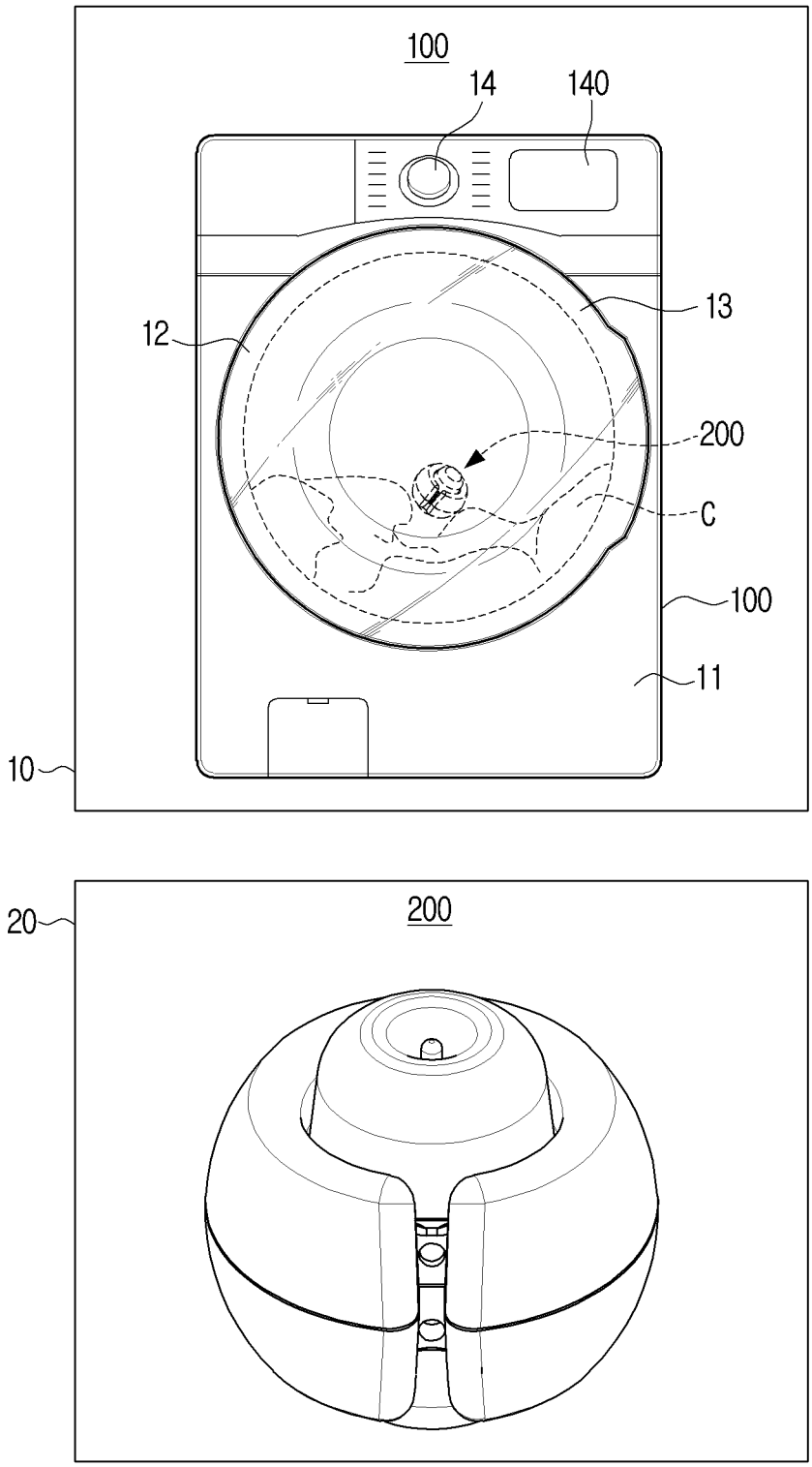
FIG. 1 is a diagram for illustrating a dry apparatus and a sensing device according to an embodiment of the present disclosure.

Hereinafter, the disclosure will be described in detail with reference to the accompanying drawings.

General terms that are currently widely used were selected as terms used in exemplary embodiments of the disclosure in consideration of functions in the disclosure, but may be changed depending on the intention of those skilled in the art or a judicial precedent, the emergence of a new technique, and the like. In addition, in a specific case, terms arbitrarily chosen by an applicant may exist. In this case, the meaning of such terms will be mentioned in detail in a corresponding description portion of the disclosure. Therefore, the terms used in the disclosure should be defined based on the meaning of the terms and the contents throughout the disclosure rather than simple names of the terms.

In the specification, an expression "have", "may have", "include", "may include", or the like, indicates existence of a corresponding feature (e.g., a numerical value, a function, an operation, a component such as a part, or the like), and does not exclude existence of an additional feature.

An expression "at least one of A and/or B" is to be understood to represent "A" or "B" or "any one of A and B".

Expressions "first", "second", or the like, used in the specification may indicate various components regardless of a sequence and/or importance of the components, will be used only to distinguish one component from the other components, and do not limit the corresponding components.

When it is mentioned that any component (for example, a first component) is (operatively or communicatively) coupled with/to or is connected to another component (for example, a second component), it is to be understood that any component is directly coupled to another component or may be coupled to another component through the other component (for example, a third component).

Singular forms are intended to include plural forms unless the context clearly indicates otherwise. It should be understood that terms "include" or "formed of" used in the specification specify the presence of features, numerals, steps, operations, components, parts, or combinations thereof mentioned in the specification, but do not preclude the presence or addition of one or more other features, numerals, steps, operations, components, parts, or combinations thereof.

In the disclosure, a "module" or a "-er/or" may perform at least one function or operation, and be implemented as hardware or software or be implemented as a combination of hardware and software. In addition, a plurality of "modules" or a plurality of "-ers/ors" may be integrated in at least one module and be implemented as at least one processor (not illustrated) except for a "module" or a "-er/or" that needs to be implemented as specific hardware.

In the specification, a term "user" may refer to a person using a dry apparatus or an apparatus (for example, an artificial intelligence dry apparatus) using the dry apparatus.

The disclosure has been devised to solve the above problems, and the disclosure provides a dry apparatus that identifies a characteristic of a subject to be dried based on a first voltage of a sensing device and controls setting of a dry process according to the identified characteristic of the subject to be dried.

Hereinafter, one or more embodiments of the disclosure will be described in detail with reference to the accompanying drawings.

FIG. 1 is a diagram for illustrating a dry apparatus and a sensing device.

Referring to FIG. 1, a dry apparatus 100 may include a cabinet 11, a door 12, a drum 13, a manipulation panel 14, and a display 140.

The dry apparatus 100 may be an apparatus that dries a subject to be dried (or laundry or wet laundry or target object for drying) C for which washing was completed. The subject to be dried C may be clothing, bedding, a towel, etc., but is not limited thereto. Here, the subject to be dried C may also be expressed as a subject to be dried.

The dry apparatus 100 may include an air circulating device (not shown) that circulates the air of the drum 13, and a hot wind supplying device (not shown) that heats air of a middle temperature and high humidity discharged from the drum 13 and makes it air of a high temperature and low humidity. For example, the subject to be dried C which is damp as washing was completed may be dried inside the drum 13 of the dry apparatus 100 according to the operations of the air circulating device and the hot wind supplying device.

For effectively drying a subject to be dried, the drum 13 may be formed to continuously rotate such that air of a high temperature and low humidity may homogeneously contact the subject to be dried.

On the front surface of the cabinet 11, an inlet through which the subject to be dried C can be taken in or taken out may be provided. The door 12 may be hinge-coupled to the front surface of the cabinet 11, and open or close the inlet of the cabinet 11.

In the upper part of the front surface of the cabinet 11, a manipulation panel 14 that can control the dry apparatus 100 may be provided. The manipulation panel 14 may include a display 140 that can display the state of the dry apparatus 100. A user may operate the dry apparatus 100 by manipulating the manipulation panel 14. Here, the manipulation panel 14 may correspond to a user interface 105. Here, the manipulation panel 14 may be implemented as a circular dial, or implemented as a touch panel.

The drum 13 may be installed to be rotatable inside the cabinet 11, and one end of the drum 13 may be installed to be in communication with the inlet of the cabinet 11.

A sensing device 200 according to one or more embodiments of the disclosure may be introduced into the inside of the drum 13 through the inlet of the dry apparatus 100.

The sensing device 200 may be a device that is introduced into the inside of the dry apparatus 100 and is movable. Here, the sensing device 200 may include an energy harvester, a sensor part, a communication interface, and a case.

The energy harvester is formed to convert a movement of the sensing device 200 into electricity. In other words, the energy harvester may generate power by using a movement of the sensing device 200.

For example, in a state wherein the sensing device 200 is put inside the drum 13 of the dry apparatus 100, if the dry apparatus 100 is operated, the drum 13 rotates. When the drum 122 rotates, the sensing device 200 introduced into the inside of the drum 13 performs a free fall movement. That is, according to the rotation of the drum 13, the sensing device 200 falls from the upper part of the inner space of the drum 13 to the lower part. Then, the energy harvester may convert the movement of the sensing device 200, i.e., the free fall movement into electricity. In other words, it may be said that the energy harvester of the sensing device 200 converts a rotating movement of the drum 13 into electricity. For this, the energy harvester may generate power by using a permanent magnet and a coil.

The energy harvester may include a cylinder, a coil, and a permanent magnet. When the sensing device 200 introduced into the drum 13 is moved by the drum 13, the energy harvester may generate power. That is, the energy harvester of the sensing device 200 may convert a rotation of the drum 13 of the dry apparatus 100 into electricity.

The sensor part may include at least one of a movement amount measurement sensor for sensing a movement amount of the sensing device 200, a harvester voltage sensor for sensing a harvester voltage of the energy harvester, a contact-type electrode sensor for sensing the dry degree of the surface contacting the sensing device 200, a temperature sensor, or a humidity sensor.

Here, the harvester voltage sensor may measure a voltage based on a movement amount of the sensing device 200. For example, as a movement amount of the sensing device 200 is greater, a harvester voltage may be measured to be higher.

Here, the contact-type voltage sensor may mean an electrode sensor for identifying the dry degree of the surface of the sensing device 200. The contact-type voltage sensor may sense how much humidity a subject to be dried has while contacting the subject to be dried. In case a subject to be dried has a lot of moisture, a voltage acquired from the contact-type voltage sensor may be measured to be low. In case a subject to be dried has no moisture or the contact-type voltage sensor does not contact a subject to be dried, a voltage acquired from the contact-type voltage sensor may be measured to be high.

The sensor part may acquire at least one of a movement amount, a harvester voltage, a moving pattern, a dry degree, a temperature, or humidity of the sensing device 200. Here, the sensor part may include at least one of a distance sensor that can measure a movement amount of the sensing device, a harvester voltage measurement sensor according to a movement, a moving pattern analysis module, a contact-type electrode sensor that can measure a dry degree, a temperature sensor, or a humidity sensor. Depending on implementation examples, the sensor part may perform only measurement of a movement amount, and analysis of a moving pattern may be performed at the dry apparatus 100.

Here, the communication interface may transmit sensing data acquired at the sensor part to the dry apparatus 100. Here, the communication interface may include a wireless communication module, and the wireless communication module may be a communication module using one of Bluetooth, WiFi, Zigbee, or Z-wave.

Here, the case may be a member enclosing the energy harvester, the sensor part, and the communication interface, and it may consist of a member for which waterproofing was performed.

Figure 2:
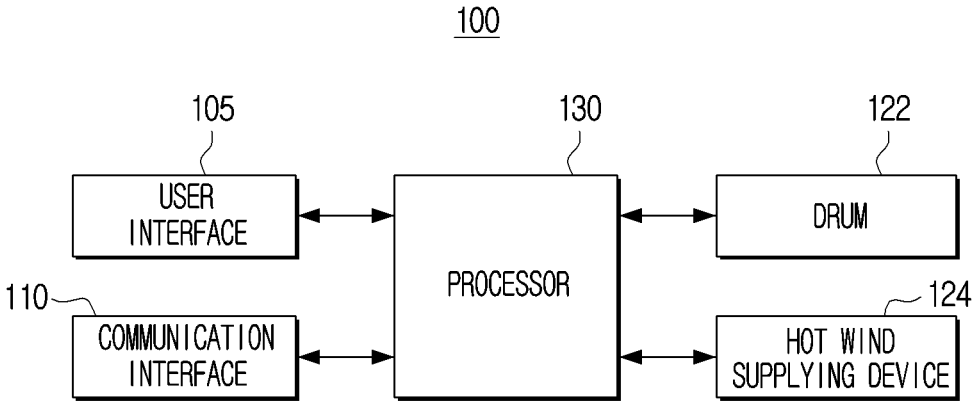
FIG. 2 is a block diagram illustrating the dry apparatus according to one or more embodiments of the disclosure.

FIG. 2 is a block diagram illustrating the dry apparatus according to one or more embodiments of the disclosure.

Referring to FIG. 2, a dry apparatus 100 may include a user interface 105, a communication interface 110, a drum 122, a hot wind supplying device 124, and a processor 130.

The user interface 105 may be implemented as a device such as a button, a touch pad, a mouse, and a keyboard or may be implemented as a touch screen that may perform both of the abovementioned display function and manipulation input function. Here, the button may be various types of buttons such as a mechanical button, a touch pad, a wheel, and the like, formed in any region such as a front surface portion, a side surface portion, a back surface portion, and the like, of a body appearance of the dry apparatus 100.

The user interface 105 may receive a dry course from the user.

The communication interface 110 is a component performing communication with various types of external apparatuses according to various types of communication manners. The communication interface 110 includes a wireless fidelity (WiFi) module, a Bluetooth module, an infrared communication module, a wireless communication module, and the like. Here, each communication module may be implemented in the form of at least one hardware chip.

The WiFi module and the Bluetooth module perform communication in a WiFi manner and a Bluetooth manner, respectively. In case of using the WiFi module or the Bluetooth module, various connection information such as a service set identifier (SSID), a session key, and the like, is first transmitted and received, communication is connected using the connection information, and various information may then be transmitted and received.

The infrared communication module performs communication according to an infrared data association (IrDA) technology of wirelessly transmitting data to a short distance using an infrared ray positioned between a visible ray and a millimeter wave.

The wireless communication module may include at least one communication chip performing communication according to various wireless communication standards such as Zigbee, $3^{rd}$ generation (3G), $3^{rd}$ generation partnership project (3GPP), long term evolution (LTE), LTE advanced (LTE-A), $4^{th}$ generation (4G), $5^{th}$ generation (5G), and the like, in addition to the communication manner described above.

In addition, the communication interface 110 may include at least one of wired communication modules performing communication using a local area network (LAN) module, an Ethernet module, a pair cable, a coaxial cable, an optical fiber cable, an ultra wide-band (UWB) module, or the like.

According to an example, the communication interface 110 may use the same communication module (for example, the WiFi module) to communicate with an external apparatus such as a remote control and an external server.

According to an example, the communication interface 110 may use different communication modules (for example, WiFi modules) to communicate with an external apparatus such as a remote control and an external server. For example, the communication interface 110 may use at least one of the Ethernet module or the WiFi module to communicate with the external server, and may use a BT module to communicate with the external apparatus such as the remote control. However, this is only an example, and the communication interface 110 may use at least one of various communication modules when it communicates with a plurality of external apparatuses or external servers.

The drum 122 may mean a dry tub accommodating a subject to be dried.

The hot wind supplying device 124 may supply a heat source to the drum 122.

The processor 130 may perform an overall control operation of the dry apparatus 100. Specifically, the processor 130 serves to control an overall operation of the dry apparatus 100.

The processor 130 may be implemented as a digital signal processor (DSP), a microprocessor, or a time controller (TCON) processing a digital signal. However, the processor 130 is not limited thereto, and may include one or more of a central processing unit (CPU), a micro controller unit (MCU), a micro processing unit (MPU), a controller, an application processor (AP), a graphics-processing unit (GPU), a communication processor (CP), and an ARM processor, or may be defined by these terms. In addition, the processor 130 may be implemented as a system-on-chip (SoC) or a large scale integration (LSI) in which a processing algorithm is embedded or may be implemented in the form of a field programmable gate array (FPGA). In addition, the processor 130 may perform various functions by executing computer executable instructions stored in a memory.

The processor 130 may control an operation of the hot wind supplying device 124 based on the dry course input through the user interface 105, and the processor 130 may control an operation time of the hot wind supplying device 124 based on sensing data.

Here, the sensing data may be data obtained from the sensing device 200. The sensing device 200 may transmit sensing data corresponding to a self-generated voltage to the dry apparatus 100. The dry apparatus 100 may receive the sensing data of the sensing device 200 through the communication interface 110. Here, self-power generation of the sensing device 200 may be a rotating movement or a falling movement according to movement of the drum 122 of the dry apparatus 100.

Meanwhile, the sensing data may include at least one of humidity or temperature.

The sensing device 200 may move along with a subject to be dried accommodated in the drum 122 by rotation of the drum 122 and may be connected to the communication interface 110 through wireless communication. The sensing device 200 may transmit the sensing data to the dry apparatus 100 by using a wireless communication method. In addition, the dry apparatus 100 may also transmit information to the sensing device 200 by using a wireless communication method.

Meanwhile, the processor 130 may acquire a voltage variation range through the sensing data and determine an operation time based on the acquired voltage variation range.

The sensing data may include a voltage corresponding to self-power generation of the sensing device 200. Further, the humidity or temperature may be determined based on the voltage value. To this end, a lookup table in which the voltage and the humidity or temperature are associated with each other may be stored in the dry apparatus 100 or the sensing device 200.

Meanwhile, the processor 130 may control a rotating operation of the drum 122, and determine an operation time based on sensing data acquired during a specific time from the time point when the drum 122 was controlled to rotate.

For example, if the processor 130 receives a dry course and a command for starting dry through the user interface 105, the processor 130 may start a dry operation. Here, the processor 130 may determine the operation time of the hot wind supplying device 124 based on sensing data received from the sensing device 200 during a predetermined time from the time point when the dry operation was started to be performed. As an example, the sensing device 200 may regularly transmit the sensing data to the dry apparatus 100, and the dry apparatus 100 may determine the operation time of the hot wind supplying device 124 based on the sensing data received from the sensing device 200 during the predetermined time from the time point when the dry operation was started to be performed. As another example, the sensing device 200 may acquire sensing data only as much as a specific time from the time point when the dry operation was started to be performed.

Here, when the dry operation starts, the processor 130 may transmit a control signal requesting sensing data to the sensing device 200. Depending on implementation examples, the processor 130 may include information on the acquisition time of the sensing data in the control signal requesting the sensing data, and transmit the signal to the sensing device 200. For example, the processor 130 may transmit a control signal requesting to send the sensing data as much as five minutes to the sensing device 200.

Meanwhile, the processor 130 may determine the operation time of the hot wind supplying device 124 as a first time based on the dry course, and determine the operation time of the hot wind supplying device 124 as a second time based on the sensing data, and the second time may be greater than the first time.

For example, if a command for performing a general dry course is received through the user interface 105, the processor 130 may acquire the first time (e.g., one hour) corresponding to the general dry course, and generate a control command to perform a dry operation as much as the first time. The processor 130 may control the hot wind supplying device 124 to operate as much as the first time. Here, the processor 130 may determine the operation time of the hot wind supplying device 124 again based on the sensing data. The time determined again based on the sensing data may be the second time. Then, the processor 130 may control the hot wind supplying device 124 to operate as much as the second time but not the first time. Here, even though the user instructed the general dry course, in actuality, a situation wherein a longer dry time is needed may occur depending on a subject to be dried. Accordingly, the processor 130 may newly determine the operation time of the hot wind supplying device 124 based on the sensing data transmitted by the sensing device 200, and control the hot wind supplying device 124 to operate as much as the newly determined second time. Here, the second time may be a bigger value than the first time.

Meanwhile, while the processor 130 controls the operation of the hot wind supplying device 124 according to the operation time, the processor 130 may change the operation time based on the humidity or the temperature.

Here, the processor 130 may control the hot wind supplying device 124 based on the first time which is a dry time corresponding to the dry course received from the user. Here, the processor 130 may acquire sensing data from the sensing device 200 while operating the hot wind supplying device 124. Then, the processor 130 may acquire a temperature or humidity based on the acquired sensing data.

As an example, the sensing device 200 may acquire a temperature or humidity based on the sensing data corresponding to a voltage according to self-power generation, and transmit the acquired temperature or the acquired humidity to the dry apparatus 100.

As another example, the sensing device 200 may transmit sensing data corresponding to a voltage according to self-power generation to the dry apparatus 100, and the dry apparatus 100 may acquire a temperature or humidity based on the acquired sensing data.

Here, the processor 130 may newly determine the dry time based on the acquired temperature or humidity. The newly determined dry time may be the second time.

Here, the processor 130 may compare the first time and the second time, and determine whether to change the dry time. If the second time is bigger than the first time, the processor 130 may change the dry time such that the hot wind supplying device 124 operates as much as the second time.

Meanwhile, the processor 130 may receive a signal corresponding to the dry degree of the subject to be dried from the dry degree sensor of the sensing device 200 contacting the subject to be dried accommodated in the drum 122, and the sensing data may include humidity data, and the processor 130 may determine whether to operate the hot wind supplying device 124 based on the humidity data acquired after the time point that was determined based on the signal transmitted from the dry degree sensor.

The sensing device 200 may include a dry degree sensor. The dry degree sensor may be arranged on the outer surface of the sensing device 200. Also, the dry degree sensor may physically contact a subject to be dried. The sensing device 200 may receive a signal corresponding to the dry degree through the dry degree sensor. Then, the sensing device 200 may include the signal corresponding to the dry degree in the sensing data, and transmit the data to the dry apparatus 100.

Here, the signal corresponding to the dry degree may be a surface voltage value. The sensing device 200 or the dry apparatus 100 may acquire humidity data based on the surface voltage value.

Here, the sensing device 200 may acquire humidity data based on the signal corresponding to the dry degree. Then, the sensing device 200 may transmit the acquired humidity data to the dry apparatus 100. Meanwhile, depending on implementation examples, the sensing device 200 may transmit a signal corresponding to the dry degree to the dry apparatus 100, and the dry apparatus 100 may acquire humidity data based on the signal corresponding to the dry degree.

Here, while the sensing device 200 already performs an operation of controlling the hot wind supplying device 124 as the first time corresponding to the dry course, the sensing device 200 may determine a new dry time based on humidity data. Here, the new dry time may be the second time. The processor 130 may determine the second time based on humidity data acquired after a predetermined time from the time point when the dry process started. For example, the processor 130 may acquire humidity data five minutes after the dry process started, and determine the second time which is a new dry time based on the acquired humidity data.

Meanwhile, the hot wind supplying device 124 may include a heat pump device that heats air by using condensed heat of a refrigerant and a blowing device, and the processor 130 may control the operation of the heat pump device based on the operation time.

Here, the processor 130 may control the operation of the heat pump device included in the hot wind supplying device 124 for operating the hot wind supplying device 124.

Meanwhile, the sensing device 200 may be a movable sensing device that exists separately from the dry apparatus 100. The sensing device 200 may include an energy harvester that is charged according to the movement of the sensing device 200. Here, the energy harvester may be a device that performs a function of converting potential energy into electronic energy based on the movement of the sensing device 200. Specifically, the energy harvester may acquire a first voltage (or a harvester voltage or a harvesting voltage) according to the movement of the sensing device 200. Then, the sensing device 200 may transmit the acquired first voltage to the dry apparatus 100. The dry apparatus 100 may rotate the drum 122 while performing the dry process. When the drum 122 rotates, the sensing device 200 that exists inside the drum 122 may rotate together, and the sensing device 200 may move up and down by a centrifugal force, etc. The energy harvester included in the sensing device 200 may acquire electronic energy based on potential and kinetic energy. Here, the electronic energy may be expressed as the first voltage.

The processor 130 may acquire a dry time corresponding to the acquired first voltage. Here, a lookup table related to the dry time according to the first voltage having various values may be stored in the memory 150 of the dry apparatus 100. The processor 130 may acquire the dry time corresponding to the first voltage based on the lookup table of the dry time according to the first voltage stored in the memory 150. Then, the processor 130 may perform the dry process as much as the dry time corresponding to the first voltage.

According to one or more embodiments, the processor 130 may control the dry apparatus 100 such that the total dry process is performed as much as the dry time corresponding to the first voltage.

According to other embodiments, the processor 130 may additionally set the dry time corresponding to the first voltage to the dry time that is currently set as the dry process is performed. The dry time of the subject to be dried may have already been determined as the dry process was performed, and the dry time corresponding to the first voltage may be used in determining whether to grant an additional time.

The processor 130 may acquire the first voltage from the sensing device 200, and acquire (or identify) characteristic information of the subject to be dried based on the acquired first voltage. Specifically, the processor 130 may acquire movement amount information including the moving distance or the moving pattern of the sensing device 200 based on the first voltage, and acquire the characteristic information of the subject to be dried based on the acquired movement amount information.

Here, the first voltage value may be a charging voltage value or a harvester voltage value measured at the energy harvester.

Also, the processor 130 may receive sensing data from the sensing device 200. Here, the sensing device 200 may be located inside the drum 122 of the dry apparatus 100. Here, while the dry process is performed, the drum 122 may rotate, and the sensing device 200 may rotate according to the rotation of the drum 122.

According to other embodiments, the sensing device 200 may include a distance sensor that can measure a movement amount according to a rotation. The distance sensor may acquire a moving distance and a moving coordinate of the sensing device 200. Accordingly, the sensing device 200 may identify how much the sensing device 200 moves, i.e., from which height to which height the sensing device 200 falls through the distance sensor. For example, if it is assumed that the sensing device 200 rotates in a state wherein the diameter of the inside of the drum 122 is 70 cm, the sensing device 200 may fall as much as a distance of between 50 cm and 70 cm whenever the drum 122 rotates. Here, the sensing device 200 may acquire movement amount information, and transmit the acquired movement amount information to the dry apparatus 100 through the communication interface of the sensing device 200. Here, the communication interface of the sensing device 200 may include a wireless communication module. The processor 130 may acquire the movement amount information from the sensing device 200. Then, the processor 130 may acquire characteristic information of the subject to be dried based on the acquired movement amount information.

Also, the dry apparatus 100 may acquire at least one of the load (or the weight), the temperature, or the humidity of the subject to be dried. Here, the dry apparatus 100 may include at least one of a sensor that can measure a load, a temperature sensor, or a humidity sensor. Depending on implementation examples, the dry apparatus 100 may include a camera, and may photograph the subject to be dried inside the drum 122 and acquire the image as image data.

The sensing device 200 may acquire at least one of the movement amount, the first voltage (or the charging voltage or the harvester voltage), the moving pattern, the dry degree, the temperature, or the humidity of the sensing device 200. Here, the sensing device 200 may include at least one of a distance sensor that can measure the movement amount of the sensing device, a harvester voltage measurement sensor according to a movement, a moving pattern analysis module, a contact-type electrode sensor that can measure a dry degree, a temperature sensor, or a humidity sensor.

Meanwhile, the processor 130 may determine a dry time corresponding to the acquired sensing data based on the characteristic information of the subject to be dried, and the characteristic information of the subject to be dried may include at least one of the type information of the subject to be dried, the volume information of the subject to be dried, the material information of the subject to be dried, the shape information of the subject to be dried, or the weight information of the subject to be dried.

Here, the dry apparatus 100 may store a lookup table including the dry time corresponding to the sensing data in the memory 150. Then, the processor 130 may operate the hot wind supplying device 124 to perform a dry process as much as the dry time corresponding to the acquired sensing data.

Here, the processor 130 may determine the dry time corresponding to the sensing data by additionally considering the characteristic information of the subject to be dried. Accordingly, even if the sensing data is the same, the dry time may be different according to the characteristic information of the subject to be dried. For example, even if the sensing value acquired from the sensing device 200 is the same, in case the subject to be dried is clothing (characteristic information), the processor 130 may acquire a dry time of one hour, and in case the subject to be dried is bedding (characteristic information), the processor 130 may acquire a dry time of two hours.

Here, the processor 130 may acquire the characteristic information of the subject to be dried based on at least one of the information directly sensed by the dry apparatus 100 or the information directly sensed by the sensing device 200.

As an example, the processor 130 may acquire the characteristic information of the subject to be dried based on the sensing data acquired from the sensing device 200.

As another example, the processor 130 may acquire the characteristic information of the subject to be dried based on the input data directly input by the user.

As still another example, the processor 130 may acquire the characteristic information of the subject to be dried based on the sensing data acquired from a sensor (e.g., a weight sensor or an image sensor) included (installed) in the dry apparatus 100.

As still another example, the processor 130 may acquire the characteristic information of the subject to be dried based on the sensing data acquired from the sensing device 200 and the sensing data acquired from the sensor of the dry apparatus 100 itself.

Here, the processor 130 may acquire sensing data including at least one of the surface dry degree of the subject to be dried, the humidity inside the drum 122, or the temperature inside the drum 122 from the sensing device 200.

The sensing device 200 may acquire a second voltage (or a surface voltage) based on a contact-type electrode sensor, and acquire the humidity information inside the drum 122 or the temperature information inside the drum 122. Then, the sensing device 200 may transmit the acquired surface voltage, humidity information, and temperature information to the dry apparatus 100. The processor 130 may acquire the characteristic information of the subject to be dried based on the sensing data including at least one of the first voltage (or the charging voltage or the harvester voltage), the second voltage (or the surface voltage), the humidity (the humidity inside the dry apparatus), or the temperature (the temperature inside the dry apparatus) received from the sensing device 200.

The type information of the subject to be dried may be information indicating to which category the subject belongs. For example, the type information of the subject to be dried may be clothing, bedding, shirts, or towels. The processor 130 may perform an appropriate dry process based on the type information of the subject to be dried. The type information of the subject to be dried may be classified according to the function of the subject. The processor 130 may determine the type of the subject to be dried based on the movement amount of the sensing device 200. If the movement amount of the subject to be dried is greater than or equal to a first threshold value, the processor 130 may identify that the subject to be dried is clothing.

For example, the volume information of the subject to be dried may mean the total volume of the subject to be dried that exists inside the drum 122. If there is one subject, the volume information may mean one volume, and if there are ten subjects, the volume information may mean ten volumes. The processor 130 may determine the volume of the subject to be dried based on the movement amount of the sensing device 200. The processor 130 may identify the falling distance in the movement amount of the subject to be dried. Then, as the falling distance is bigger, the processor 130 may determine that the volume of the subject to be dried is smaller. Here, the falling distance may mean the distance that the sensing device 200 moved in a vertical direction when the drum 122 rotated once.

The material information of the subject to be dried, and the shape information of the subject to be dried may mean the texture. For example, the material information of the subject to be dried may be cotton, wool, polyester, nylon, silk, denim, leather, cashmere, etc. The material information of the subject to be dried may be classified according to the fabric of the cloth. The processor 130 may determine the material of the subject to be dried based on a moving distance of the sensing device 200 (the moving distance acquired by the first voltage received from the sensing device 200) or the surface voltage acquired from the contact-type electrode sensor. If the frictional force of the material is higher, the moving distance of the sensing device 200 may become shorter, and the surface voltage may be different. Accordingly, the dry apparatus 100 may store a data set according to various materials in advance, and compare the sensed surface voltage value and the data set.

The shape information of the subject to be dried may be information indicating which shape the subject has. For example, the shape information of the subject to be dried may mean a basic shape, a cube shape, a sphere shape, and a cylinder shape. Here, the basic shape may mean a shape that is identified when rotating the drum 122 for drying general clothing, etc. The basic shape may mean a general shape. The basic shape may be a shape in an example 510 and an example 520 of FIG. 5. The sphere shape may be a shape in an example 530 of FIG. 5. The processor 130 may determine the shape of the subject to be dried based on the movement amount of the sensing device 200.

The weight information of the subject to be dried may indicate the load of the subject. For example, the weight of the subject to be dried may be a weight in a specific unit such as 5 kg and 10 kg.

Meanwhile, in the aforementioned description, it was described that the processor 130 acquires the characteristic information of the subject to be dried based on the movement amount of the sensing device 200, but the harvester voltage, the moving pattern, the dry degree, the temperature, or the humidity may be additionally considered other than the movement amount of the sensing device 200.

The processor 130 may determine the most appropriate dry method to the subject to be dried by acquiring the characteristic information of the subject to be dried. Specifically, the processor 130 may acquire setting information corresponding to the most appropriate dry process for the subject to be dried. The setting information may include at least one of the dry time, the dry temperature, the strength of hot wind, or the rotating speed of the drum 122. For example, if it is identified that the subject to be dried is silk, the processor 130 may determine the dry time, the dry temperature, and the strength of hot wind appropriate for silk.

Meanwhile, the processor 130 may acquire the moving distance of the sensing device 200 based on the first voltage, and if the acquired moving distance is greater than or equal to the first threshold value, the processor 130 may control the hot wind supplying device 124 to operate as much as the dry time corresponding to clothing, and if the acquired moving distance is smaller than the first threshold value, the processor 130 may control the hot wind supplying device 124 to operate as much as the dry time corresponding to bedding.

Here, as the first voltage value (the charging voltage) is higher, the moving distance may be greater. Accordingly, as the acquired first voltage value of the sensing device 200 is higher, the processor 130 may determine that the moving distance of the sensing device 200 is greater.

As clothing generally does not have a big volume, there may be a lot of empty spaces inside the drum 122. In particular, as moist clothing is in a contracted state, there may be a lot of empty spaces inside the drum 122 while a dry process is being performed. Accordingly, when drying clothing, there may be a lot of spaces wherein the sensing device 200 can move, and the moving distance of the sensing device 200 may be greater.

In contrast, as bedding has a big volume, there may not be a lot of empty spaces inside the drum 122. Accordingly, when drying bedding, there may not be a lot of spaces wherein the sensing device 200 can move, and the moving distance of the sensing device 200 may be smaller.

The processor 130 may acquire the moving distance of the sensing device 200 at a predetermined time point, and if the acquired moving distance is greater than or equal to the first threshold value, the processor 130 may identify that the subject to be dried is clothing. Meanwhile, if the acquired moving distance is smaller than the first threshold value, the processor 130 may identify that the subject to be dried is bedding. Detailed explanation related to this feature will be made below FIG. 10.

In the aforementioned description or the description below, an operation of identifying clothing or bedding may not be an operation that should necessarily be performed. The processor 130 may determine a dry time based on an acquired moving distance and the first threshold value, without going through an operation of determining (identifying) clothing/bedding.

Depending on implementation examples, the processor 130 may not go through an operation of determining (identifying) clothing/bedding, and if the acquired moving distance is greater than or equal to the first threshold value, the processor 130 may perform a dry process as much as the dry time corresponding to clothing, and if the acquired moving distance is smaller than the first threshold value, the processor 130 may perform a dry process as much as the dry time corresponding to bedding. Here, the operation of performing a dry process may mean rotating the drum 122 or operating the hot wind supplying device 124. Here, the predetermined time point may be the time point when a predetermined time passed after the time point when the dry process started. The predetermined time point or the predetermined time may be changed according to the user's setting. Also, the first threshold value may be changed according to the user's setting. Meanwhile, depending on implementation examples, if the predetermined time point is changed, the first threshold value may also be changed. Detailed explanation related to the first threshold will be made below FIG. 8 and FIG. 12.

Meanwhile, the processor 130 may acquire the moving distance of the sensing device 200 based on the first voltage value, and acquire the second voltage value from the sensing device 200, and acquire the surface dry degree of the subject to be dried based on the second voltage value. Also, if the acquired moving distance is greater than or equal to the first threshold value, the processor 130 may control the hot wind supplying device 124 to operate as much as the dry time corresponding to clothing, and if the acquired moving distance is smaller than the first threshold value and the acquired surface dry degree of the subject to be dried is greater than or equal to the second threshold value, the processor 130 may control the hot wind supplying device 124 to operate as much as the dry time corresponding to bedding, and if the acquired moving distance is smaller than the first threshold value and the acquired surface dry degree of the subject to be dried is smaller than the second threshold value, the processor 130 may control the hot wind supplying device 124 to operate as much as the dry time corresponding to clothing.

Here, the processor 130 may additionally consider the surface dry degree other than the moving distance. The surface dry degree may be determined based on the surface voltage received from the sensing device 200. The sensing device 200 may include a contact-type electrode sensor, and acquire a surface voltage. Here, the surface voltage may mean a voltage sensed at the surface of the sensing device 200, and depending on whether the sensing device 200 contacts the subject to be dried, the sensed surface voltage may be different. In general, if there is moisture in the contacting part, the surface voltage may be sensed to be low.

The processor 130 may analyze the surface voltage received from the sensing device 200 at a predetermined time point, and acquire the surface dry degree. Then, if the surface dry degree is greater than or equal to the second threshold value, the processor 130 may identify that the subject to be dried is bedding, and if the surface dry degree is smaller than the second threshold value, the processor 130 may identify that the subject to be dried is clothing. Bedding has a bigger volume than clothing. Accordingly, the time necessary for drying the entire bedding is greater than the time necessary for drying the entire clothing. However, when considering only the surface, the surface of the bedding may be dried faster. This is because bedding consists of a light cotton material, and while the volume is big, the weight or the density is low. Accordingly, the processor 130 may acquire the surface dry degree at the predetermined time point and compare the surface dry degree with the second threshold value, and if the surface dry degree is greater than or equal to the second threshold value, the processor 130 may identify that the subject to be dried is bedding. Here, the predetermined time point may be changed according to the user's setting. The predetermined time point may be the time point when the predetermined time passed after the dry process started. However, here, the predetermined time point may be 10 minutes to within 30 minutes. This is because the surface dry degree may become close to the maximum value for both of clothing and bedding in case too much time passed. Accordingly, the user may determine in advance the time point when the dry degree of the surface of bedding and the dry degree of the surface of clothing are different, and use the time point as the predetermined time point.

The operation of identifying clothing or identifying bedding based on the moving distance may not be an operation that should necessarily be performed. Depending on implementation examples, the processor 130 may not go through the operation of determining (identifying) clothing/bedding, but determine the dry time based on the acquired moving distance, first threshold value, surface dry degree, and second threshold value.

Meanwhile, detailed explanation related to this feature will be made below FIG. 12.

Meanwhile, the processor 130 may perform additionally dry during a first time for operating as much as the dry time corresponding to clothing, and the processor 130 may perform additional dry during a second time longer than the first time for operating as much as the dry time corresponding to bedding.

Here, the first time may be 0 hour. If the subject to be dried is identified as clothing, the processor 130 may not grant (or allot) a separate additional time. However, if the subject to be dried is identified as bedding, the processor 130 may grant (or allot) an additional time to the dry process for perfect dry.

The processor 130 may identify the type of the subject to be dried at the predetermined time point, and determine whether to grant an additional time. As bedding has a big volume unlike clothing, a longer dry time may be needed. Also, a case wherein dry of the inner surface is not completed even though dry of the outer surface was completed may occur. Accordingly, if the subject to be dried is identified as bedding, the processor 130 may additionally perform the dry process as much as an additional time other than the basic time.

Meanwhile, the processor 130 may acquire the moving pattern information of the sensing device 200 based on the first voltage value, and if it is identified that a specific moving pattern is repeated based on the acquired moving pattern information, the processor 130 may control the hot wind supplying device 124 to operate as much as the dry time corresponding to clothing, and if it is identified that the moving pattern is irregular based on the acquired moving pattern information, the processor 130 may control the hot wind supplying device 124 to operate as much as the dry time corresponding to bedding.

As an example of acquiring the moving pattern information of the sensing device 200 based on the first voltage value, the moving pattern information may be acquired by the sensing device 200, and the processor 130 may acquire the moving pattern information from the sensing device 200.

As another example, the processor 130 may acquire the first voltage from the sensing device 200, and acquire the movement amount information corresponding to the sensing device 200 based on the acquired first voltage. Then, the processor 130 may analyze the acquired movement amount information, and acquire (or analyze) the moving pattern.

The moving pattern may be information indicating in which pattern the sensing device 200 is moving. For example, while general clothing is being dried, the sensing device 200 may rise and descend (or fall) in a vertical direction according to the rotation of the drum 122. Also, as the rotation of the drum 122 occurs repeatedly, the rising and descending pattern may be identified repeatedly. However, while bedding is being dried, the sensing device 200 may irregularly rise and descend in spite of the rotation of the drum 122. This is because, as the volume of the bedding is big, the movement of the sensing device 200 may be restrictive.

Meanwhile, detailed explanation related to this feature will be made below FIG. 11.

Meanwhile, the processor 130 may acquire the second voltage value from the sensing device 200, and while the hot wind supplying device 124 is being controlled, the processor 130 may calculate the number of times that the second voltage value is smaller than the third threshold value during a threshold time based on the current time point, and acquire the surface dry degree information of the subject to be dried based on the calculated number of times.

Here, the processor 130 may acquire the surface voltage value from the sensing device 200, and identify whether the acquired surface voltage value is smaller than the third threshold value. Then, the processor 130 may calculate the number of times that the surface voltage value is smaller than the third threshold value during the threshold time (e.g., 30 seconds) based on the current time point. The feature that the surface voltage value is identified to be low may mean that the humidity is high or there is moisture. Accordingly, the processor 130 may determine the surface dry degree based on the number of times that the surface voltage value is smaller than the third threshold value. As the calculated number of times is more during the threshold time, the processor 130 may identify that the dry degree is lower. Here, the processor 130 may set the standard for the surface dry degree as the third threshold value, and calculate the number of times that the surface voltage value is smaller than the third threshold value during the threshold time.

Here, detailed explanation related to the third threshold will be made below FIG. 9 and FIG. 13.

Meanwhile, if the acquired moving distance is greater than or equal to the first threshold value, the processor 130 may control the hot wind supplying device 124 to operate as much as the dry time corresponding to clothing, and if the acquired moving distance is smaller than the first threshold value and the calculated number of times is greater than or equal to the threshold number of times, the processor 130 may control the hot wind supplying device 124 to operate as much as the dry time corresponding to clothing, and if the acquired moving distance is smaller than the first threshold value and the calculated number of times is smaller than the threshold number of times, the processor 130 may control the hot wind supplying device 124 to operate as much as the dry time corresponding to bedding.

The processor 130 may calculate the number of times that the surface voltage value is smaller than the third threshold value during the threshold time, and classify the type of the subject to be dried depending on whether the calculated number of times is greater than or equal to the threshold number of times. As the calculated number of times is more, it may mean that there is more moist on the surface of the subject to be dried, and the dry degree is low. Accordingly, if the calculated number of times is greater than or equal to the threshold number of times, the processor 130 may determine that the subject to be dried has moisture, and that the subject to be dried is clothing.

The operation of identifying clothing or bedding may not be an operation that should necessarily be performed. The processor 130 may not go through the operation of determining (identifying) clothing/bedding, but determine the dry time based on the calculated number of times and the threshold number of times.

Meanwhile, the processor 130 may control the dry apparatus 100 based on the setting information corresponding to the voltage (the first voltage value), and the setting information corresponding to the voltage (the first voltage value) may include at least one of the dry time, the dry temperature, the strength of the hot wind, or the rotating speed of the drum 122.

Here, the operation of controlling the dry apparatus 100 may mean all control operations necessary for a dry process such as an operation of rotating the drum 122 or an operation of operating the hot wind supplying device 124, etc. for performing a dry process.

The aforementioned threshold value, threshold time, and threshold number of times may be values that were determined by a user in advance. Also, the aforementioned values may vary according to time points. For example, as in the graphs disclosed in FIG. 7 to FIG. 9, the values of sensing data may vary according to time, and thus the threshold value, the threshold time, and the threshold number of times for analyzing sensing data may also vary according to measurement times.

As an example, sensing data may be measured after a predetermined time point from the time point when the dry process starts (e.g., 30 minutes). This is because, in case of determining the surface dry degree after about 30 minutes passed, the dry degree may clearly vary according to the type of the subject to be dried. In case of using only the movement amount of the sensing device 200 but not the surface dry degree, the predetermined time point may be shorter (e.g., 30 seconds).

As another example, sensing data may be measured in case a predetermined event occurred. For example, the predetermined event may be an event wherein the internal humidity (acquired by the dry apparatus 100 by itself) is determined to be smaller than the threshold humidity or an event wherein the dry process is completed.

Meanwhile, the dry apparatus 100 according to one or more embodiments of the disclosure may determine the characteristic information of the subject to be dried based on the movement amount of the sensing device 200. Accordingly, the dry apparatus 100 may automatically perform a dry process appropriate for the subject to be dried even if the user does not directly input the characteristic of the subject to be dried. Accordingly, the dry apparatus 100 can provide high convenience to the user.

Meanwhile, the dry apparatus 100 according to one or more embodiments of the disclosure may acquire the surface dry degree of the subject to be dried by using the surface voltage value. When the surface dry degree is considered other than the movement amount, the material or other characteristics of the subject to be dried may be determined clearly. This is because, even if the dry process is performed for the same time and at the same temperature, the surface dry degree of the subject to be dried is partially different according to the material. Accordingly, the dry apparatus 100 may clearly analyze various subjects to be dried, and provide appropriate dry methods. Accordingly, the dry apparatus 100 may apply an appropriate dry method such that the subject to be dried is not damaged according to a high temperature.

Meanwhile, in the above, only simple components constituting the dry apparatus 100 were illustrated and described, but in actual implementation, various components may additionally be provided. Explanation in this regard will be made below with reference to FIG. 3.

Figure 3:
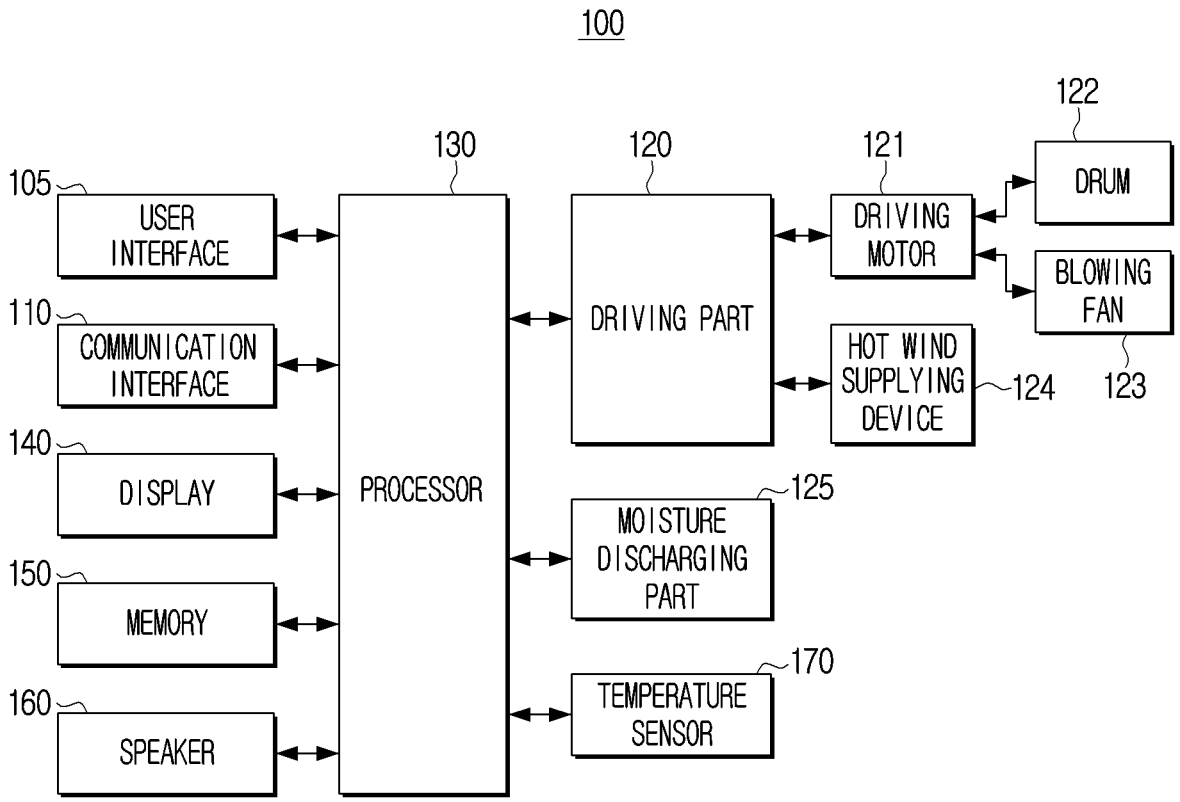
FIG. 3 is a block diagram for illustrating a detailed configuration of the dry apparatus of FIG. 1 according to an embodiment of the present disclosure.

FIG. 3 is a block diagram for illustrating a detailed configuration of a dry apparatus of FIG. 1.

Referring to FIG. 3, the dry apparatus 100 may consist of a user interface 105, a communication interface 110, a driving part 120, a driving motor 121, a drum 122, a blowing fan 123, a hot wind supplying device 124, a moisture discharging part 125, a processor 130, a display 140, a memory 150, a speaker 160, and a temperature sensor 170.

Meanwhile, among the operations of the communication interface 110 and the processor 130, regarding the same operations as the operations described above, overlapping explanation will be omitted.

The driving part 120 may drive the driving motor 121 based on a driving control signal generated by the processor 130.

The driving motor 121 may receive power and generate a driving force, and the driving motor 121 may transmit the generated driving force to the drum 122 and the blowing fan 123.

The drum 122 may mean a dry tub accommodating the subject to be dried. The drum 122 may be rotated by the driving force generated from the driving motor 121.

The blowing fan 123 may mean a fan that circulates air of a high temperature supplied to the drum of the dry apparatus 100. Specifically, the blowing fan 123 may receive a driving control signal generated by the processor 130, and rotate to circulate the air inside the drum to which a heat source was supplied.

The driving part 120 may receive the driving control signal generated by the processor 130, and drive the hot wind supplying device 124 such that it can supply a heat source to the drum.

The hot wind supplying device 124 may supply a heat source to the drum 122.

The hot wind supplying device 124 may be implemented by a gas type heat source supplying method or an electricity type heat source supplying method. The gas type method may mean a method of heating air by using gas. The electricity type method may mean a method of heating air by using electricity. The electricity type method may be a method of using at least one of a hot wind supplying device or a heat pump. The hot wind supplying device may use a method of supplying a heat source by using a heat wire, etc. The heat pump may use a method of supplying a heat source by using a refrigerant. The heat pump may consist of an evaporator, a compressor, and a condenser. Specifically, the evaporator may evaporate a refrigerant in a liquid state to a gaseous state. Then, the refrigerant in a gaseous state may be transmitted to the compressor. The compressor may compress the refrigerant in a state of a high temperature and high pressure. Then, the compressed refrigerant may be transmitted to the condenser. The condenser may perform a heat-exchanging operation from the compressed refrigerant and take heat, and heat the air with the taken heat and discharge the air. Here, the discharged air of a hot temperature may be supplied to the drum 122 of the dry apparatus 100. The refrigerant from which heat was taken by the condenser may be transmitted to the evaporator and circulated.

The moisture discharging part 125 may discharge moisture inside the dry apparatus 100. The dry apparatus 100 may be a vent type (a hot wind discharging method) or a condensing type (a hot wind dehumidifying method) according to the method of discharging moisture. The vent type method may be a method of discharging moisture and dust to the outside of the dry apparatus 100. The condensing type method may be a method of filtering dust through a filter and making moisture pass through a condenser (a heat exchanger), and converting the moisture into condensed water. The condensed water may be discharged to the outside of the dry apparatus 100 or stored in an inner tub of the dry apparatus 100.

The display 140 may be implemented as displays in various forms such as a liquid crystal display (LCD), an organic light emitting diodes (OLED) display, a plasma display panel (PDP), etc. Inside the display 140, driving circuits that may be implemented in forms such as an a-si TFT, a low temperature poly silicon (LTPS) TFT, an organic TFT (OTFT), etc., a backlight unit, etc. may also be included. Meanwhile, the display 140 may be implemented as a touch screen combined with a touch sensor, a flexible display, a three-dimensional display (a 3D display), etc.

Also, the display 140 according to one or more embodiments of the disclosure may include not only a display panel outputting images, but also a bezel housing the display panel. In particular, the bezel according to one or more embodiments of the disclosure may include a touch sensor (not shown) for detecting user interactions.

The memory 150 may be implemented as an internal memory such as a ROM (e.g., an electrically erasable programmable read-only memory (EEPROM)), a RAM, etc. included in the processor 130, or implemented as a separate memory from the processor 130. In this case, the memory 150 may be implemented in a form of a memory embedded in the dry apparatus 100, or in a form of a memory that can be attached to or detached form the dry apparatus 100 according to the use of stored data. For example, in case of data for an operation of the dry apparatus 100, the data may be stored in a memory embedded in the dry apparatus 100, and in case of data for an extended function of the dry apparatus 100, it may be stored in a memory that can be attached to or detached from the dry apparatus 100.

Meanwhile, in case of a memory embedded in the dry apparatus 100, it may be implemented as at least one of a volatile memory (e.g.: a dynamic RAM (DRAM), a static RAM (SRAM), or a synchronous dynamic RAM (SDRAM), etc.) or a non-volatile memory (e.g.: a one time programmable ROM (OTPROM), a programmable ROM (PROM), an erasable and programmable ROM (EPROM), an electrically erasable and programmable ROM (EEPROM), a mask ROM, a flash ROM, a flash memory (e.g.: a NAND flash or a NOR flash, etc.), a hard drive, or a solid state drive (SSD)). Meanwhile, in case of a memory that can be attached to or detached from the dry apparatus 100, it may be implemented as forms such as a memory card (e.g., a compact flash (CF), a secure digital (SD), a micro secure digital (Micro-SD), a mini secure digital (Mini-SD), an extreme digital (xD), a multi-media card (MMC), etc.), an external memory that can be connected to a USB port (e.g., a USB memory), and the like.

The speaker 160 may be a component that outputs not only various kinds of audio data processed at an input/output interface, but also various kinds of notification sounds or voice messages, etc.

The temperature sensor 170 may sense the temperature inside the dry apparatus 100. The temperature sensor 170 may include at least one of a first temperature sensor sensing the temperature of the air of the drum 122 inside the dry apparatus 100 or a second temperature sensor sensing the temperature of the refrigerant inside the dry apparatus 100. The temperature data sensed by the temperature sensor 170 may be transmitted to the processor 130, and the processor 130 may control the operation of the dry apparatus 100 based on the sensed temperature data.

Figure 4:
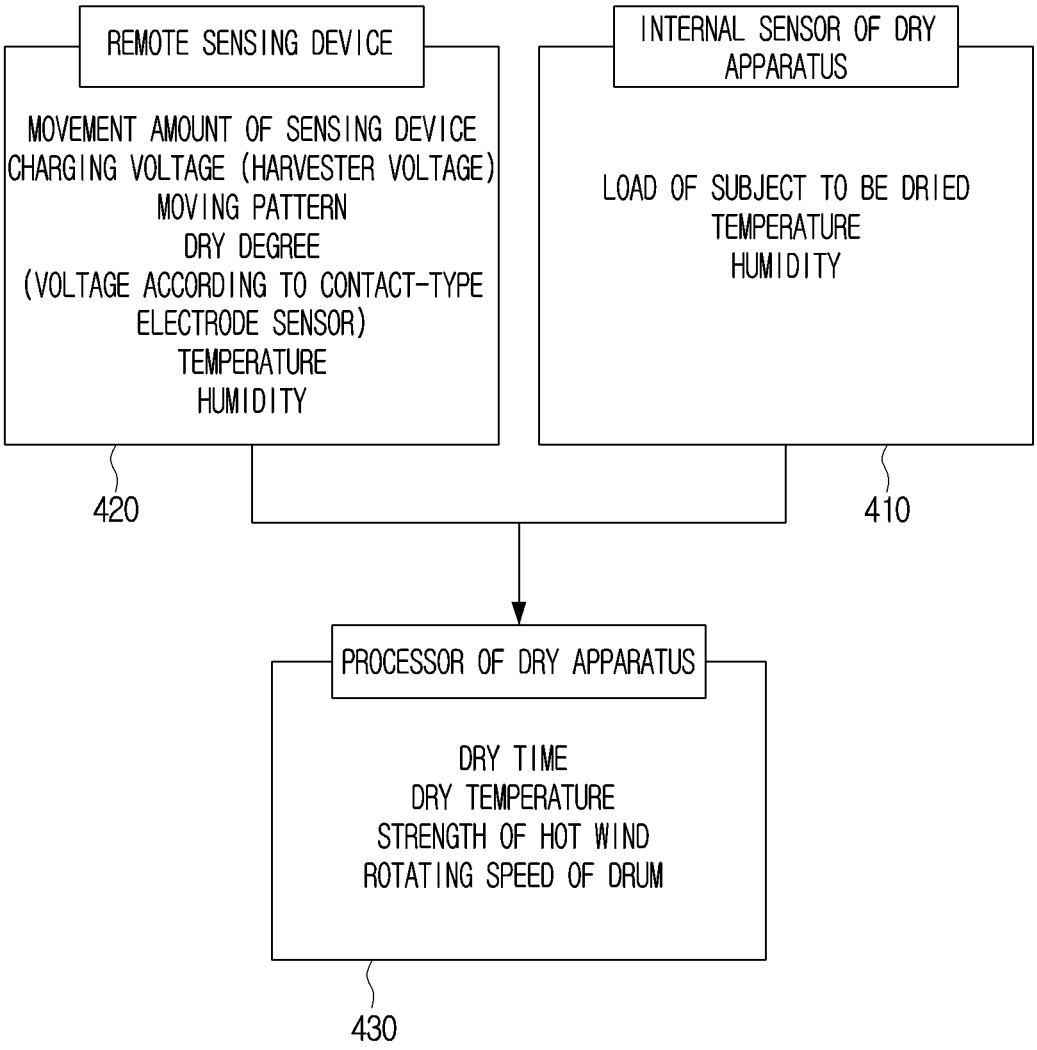
FIG. 4 is a diagram for illustrating an operation of controlling a dry process based on information received from the dry apparatus and the sensing device according to an embodiment of the present disclosure.

FIG. 4 is a diagram for illustrating an operation of controlling the dry process based on information received from the dry apparatus and the sensing device.

Referring to FIG. 4, an internal sensor of the dry apparatus 100 may acquire at least one 410 of a load (or weight), a temperature, or humidity of a subject to be dried. Here, the dry apparatus 100 may include at least one of a sensor that may measure a load, a temperature sensor, or a humidity sensor.

In addition, the sensing device 200 that may wirelessly transmit the sensing data to the dry apparatus 100 may acquire at least one 420 of a movement amount, a harvester voltage, a moving pattern, a dry degree, a temperature, or humidity of the sensing device 200. Here, the sensing device 200 may include at least one of a distance sensor that may measure a movement amount of the sensing device, a harvester voltage measurement sensor according to a movement, a moving pattern analysis module, a contact-type electrode sensor that may measure a dry degree, a temperature sensor, or a humidity sensor.

Further, the processor 130 of the dry apparatus 100 may acquire at least one 430 of the dry time, the dry temperature, the strength of hot wind, or the rotating speed of the drum 122 of the dry apparatus 100 based on at least one of information acquired from the internal sensor of the dry apparatus 100 or information acquired from the sensing device 200. Meanwhile, the dry apparatus 100 may acquire detailed setting in an initial stage of the dry process or change the detailed setting during the dry process.

Figure 5:
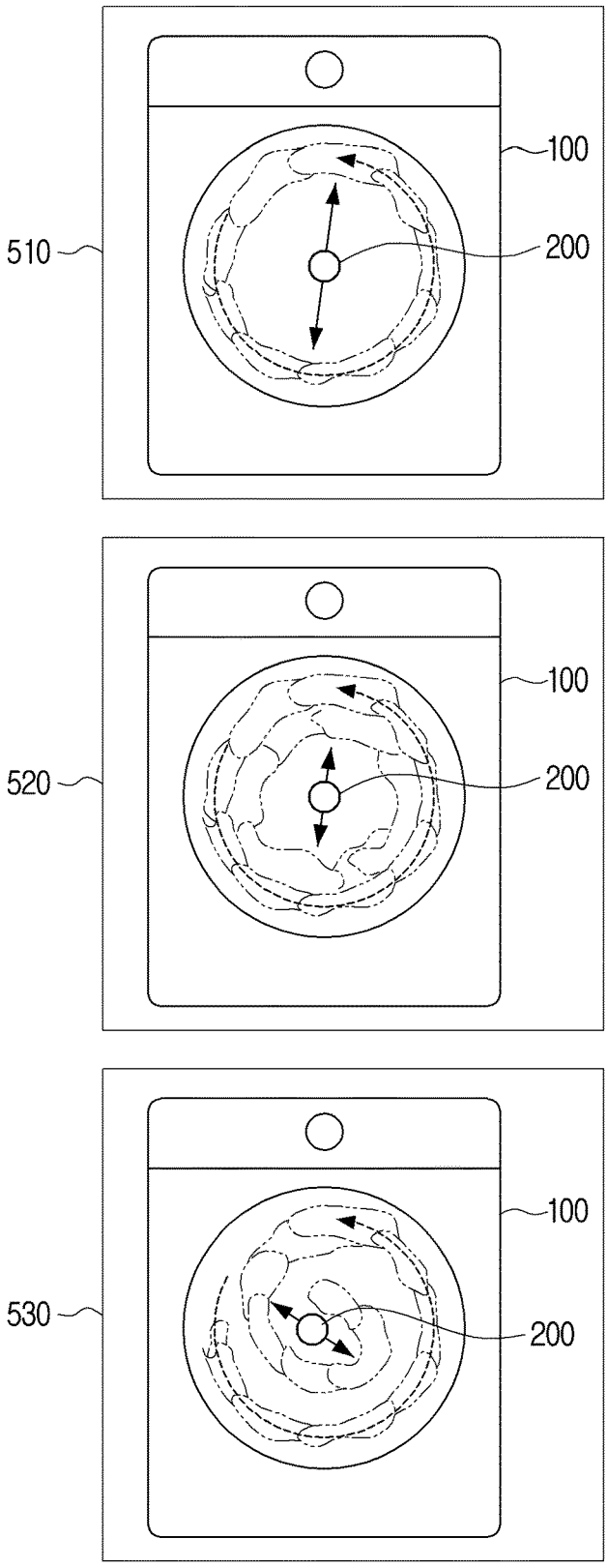
FIG. 5 is a view for illustrating a plurality of examples according to a type and volume of a subject to be dried according to an embodiment of the present disclosure.

FIG. 5 is a view for illustrating a plurality of examples according to a type and volume of a subject to be dried.

Referring to FIG. 5, the movement amount of the sensing device 200 may vary according to subjects to be dried.

According to the example 510, it is assumed that the subject to be dried is a small amount of clothing. The small amount of clothing may be in close contact with an inner surface of the drum 122 during the dry process, and the sensing device 200 may move within the drum 122. Here, the sensing device 200 may move within the drum 122 during the dry process. For example, the sensing device 200 may fall about 50 cm while the small amount of clothing is dried.

According to another example 520, it is assumed that the subject to be dried is a larger amount of clothing. Here, the sensing device 200 may move within the drum 122 during the dry process. For example, the sensing device 200 may fall about 25 cm while the large amount of clothing is dried. In the example 520, a larger amount of clothing is dried compared to the example 510, the total volume of the subject to be dried in the example 520 may be larger than the total volume of the subject to be dried in the example 510. Therefore, in the example 520, a falling distance of the sensing device 200 may be smaller than that in the example 510.

According to another example 530, it is assumed that the subject to be dried is bedding. Here, the sensing device 200 may move within the drum 122 during the dry process. For example, the sensing device 200 may fall about 25 cm while bedding is dried. Although the types of subjects to be dried assumed in the example 520 and the example 530 are different, the volumes thereof may be the same. Therefore, the falling distances of the sensing device 200 may be similar to each other, that is, 25 cm. However, in the example 530, the bedding may be only one piece unlike clothing. Accordingly, a situation in which the sensing device 200 does not move for a certain period of time or slightly moves may occur. In the example 520, even if there is a large amount of clothing, the sensing device 200 may always move, for example, fall regularly. However, in the example 530, the sensing device 200 may irregularly move.

Figure 6:
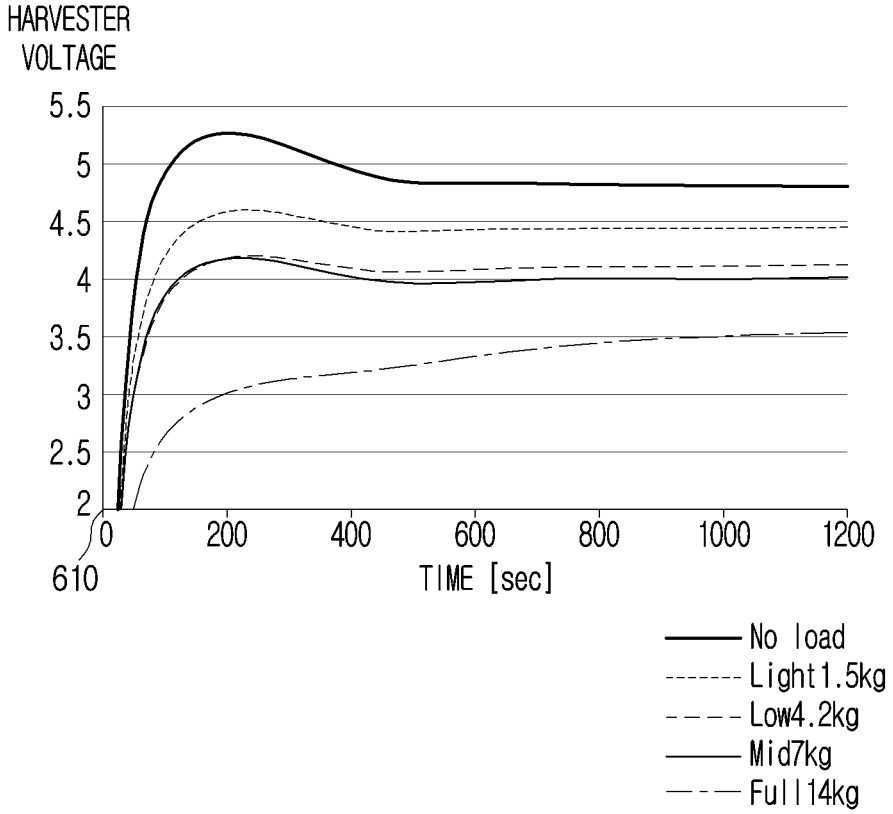
FIG. 6 is a graph for illustrating a cumulative average of a harvester voltage over time according to an embodiment of the present disclosure.

FIG. 6 is a graph for illustrating a cumulative average of a harvester voltage over time.

Referring to FIG. 6, the sensing device 200 may acquire the harvester voltage according to a movement amount. Here, the harvester voltage may mean a voltage measured by the sensing device 200 according to the movement amount. As the number of subjects to be dried increases, an empty space of the drum 122 may decrease. Further, as the empty space of the drum 122 decreases, the movement amount of the sensing device 200 may decrease. In addition, as the movement amount of the sensing device 200 decreases, the harvester voltage may decrease.

A graph 610 may indicate a change in harvester voltage depending on a load of a subject to be dried. As the load increases, the space of the drum 122 decreases and the movement amount of the sensing device 200 may decrease. Further, as the movement amount of the sensing device 200 decreases, the harvester voltage may decrease.

FIG. 7 is a graph for illustrating a change in harvester voltage according to the plurality of examples.

Referring to FIG. 7, a graph 710 may indicate a change in harvester voltage according to one or more embodiments. It is assumed that the subject to be dried is a plurality of clothes. Because the sizes and volumes of clothes are constant, the clothes may be rotated in a certain shape during the dry process. For example, the clothes as the subject to be dried may be rotated in a state of being in close contact with the inner surface of the drum 122 by a centrifugal force as in the example 510 or 520 of FIG. 5. Therefore, even at the time of rotation of the drum 122, a predetermined space may always be empty, and the sensing device 200 may move through the empty space. Further, the moving pattern of the drum 122 may be regular. Accordingly, the harvester voltage acquired according to the movement amount of the sensing device 200 may also be regularly acquired.

A graph 720 may indicate a change in harvester voltage according to one or more embodiments. It is assumed that the subject to be dried is bedding. The volume of the bedding may be larger than that of general clothing. In addition, the bedding corresponds to one large subject to be dried, and thus, the sensing device 200 may not be able to move freely. For example, in case of the bedding as the subject to be dried, the movement of the sensing device 200 may be stopped for a certain period of time as in the example 530 of FIG. 5. Therefore, the harvester voltage may be acquired irregularly. In a period t1, a low harvester voltage may be acquired. The period t1 may be a period in which it is difficult for the sensing device 200 to move inside the bedding.

Figure 8:
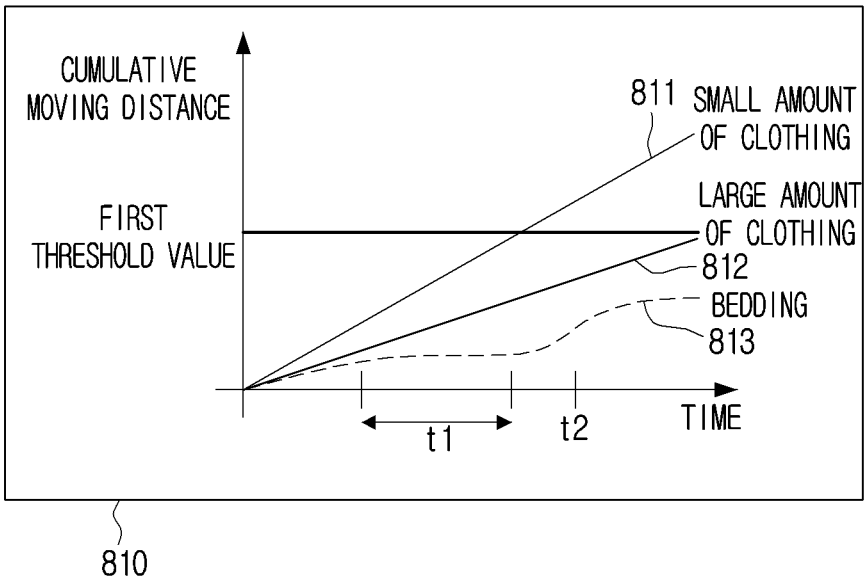
FIG. 8 is a graph for illustrating a change in moving distance according to the plurality of examples and embodiment(s) of the present disclosure.

FIG. 8 is a graph for illustrating a change in moving distance according to the plurality of examples.

Referring to FIG. 8, a graph 810 may indicate a cumulative moving distance of the sensing device 200 over time.

According to one or more embodiments, a change in cumulative moving distance of the sensing device 200 over time may be indicated. Generally, in case that the subject to be dried is clothing, the volume may vary according to the amount of the subject to be dried. In case that the amount of clothing is small, the volume occupied by the clothes during the dry process may be small, and the empty space of the drum 122 may be large. In case that the empty space of the drum 122 is large, the moving distance of the sensing device 200 may be large. On the other hand, in case that the amount of clothing is large, the volume occupied by the clothes during the dry process may be large, and the empty space of the drum 122 may be small. In case that the empty space of the drum 122 is small, the moving distance of the sensing device 200 may be small. Comparing the cumulative moving distances at the same time point, the moving distance in case of a small amount of clothing 811 may be greater than the moving distance in case of a large amount of clothing 812.

According to other embodiments, a change in cumulative moving distance of the sensing device 200 over time may be indicated. In case that the subject to be dried is bedding 813, the movement amount of the sensing device 200 may be irregular. The period t1 of the graph 720 of FIG. 7 and a period t1 of the graph 820 of FIG. 8 may correspond to each other. In case that the movement amount of the sensing device 200 is small, the acquired harvester voltage may also be low.

Figure 9:
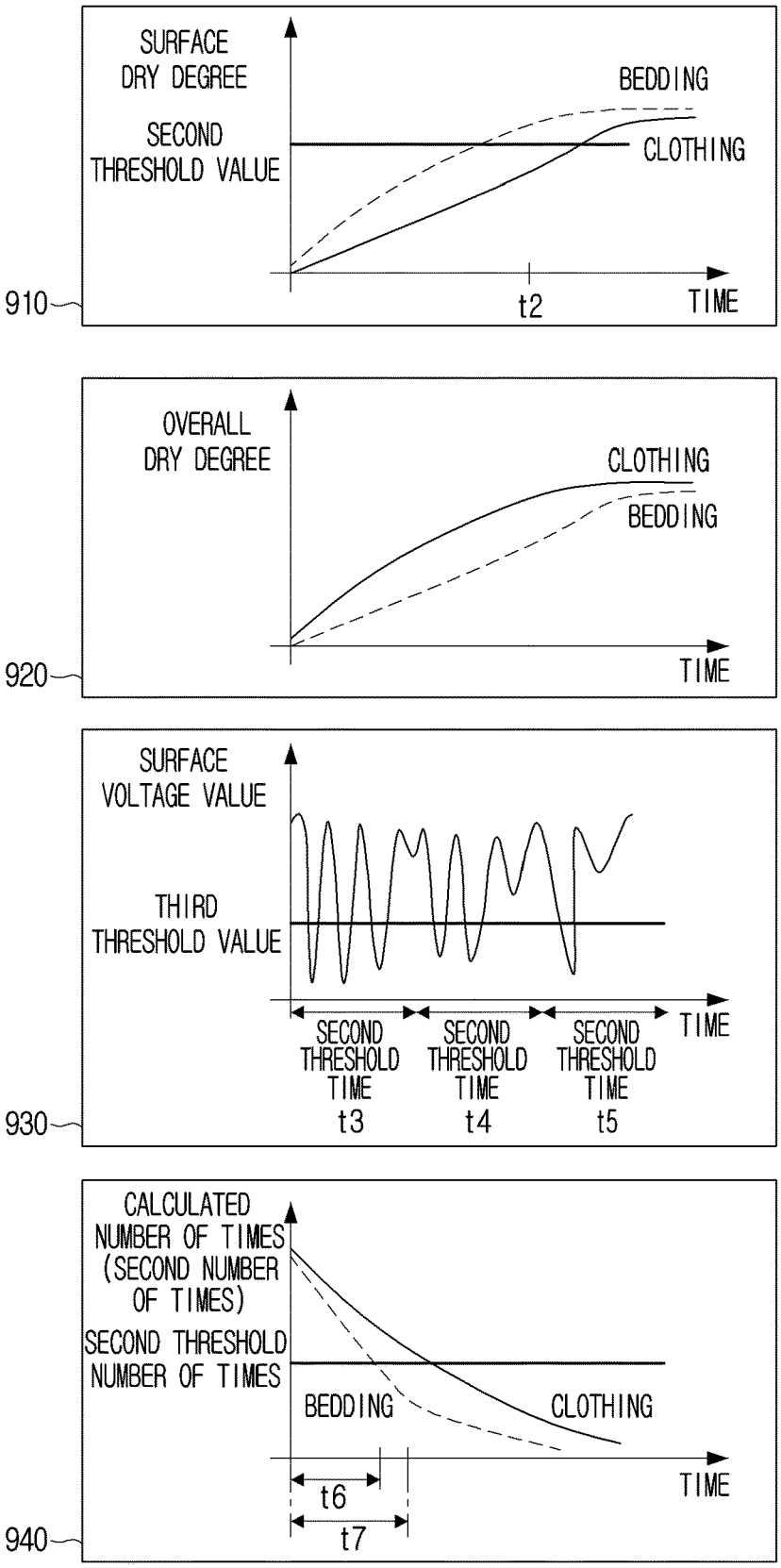
FIG. 9 is a graph for illustrating changes in surface dry degree, overall dry degree, and calculated number of times according to the plurality of examples and embodiment(s) of the present disclosure.

FIG. 9 is a graph for illustrating changes in surface dry degree, overall dry degree, and calculated number of times according to the plurality of examples.

Referring to FIG. 9, a graph 910 may indicate a change in surface dry degree over time. Here, the surface dry degree is measured by the sensing device 200 and may mean the dry degree of the surface of the sensing device 200. Here, the surface dry degree is measured on the surface of the sensing device 200, and thus, the surface dry degree may be different from the overall dry degree of the subject to be dried. That is, the surface dry degree may mean the dry degree itself measured on the surface of the sensing device 200. In general, the volume of bedding may be larger than that of clothing. Further, the surface of bedding may be dried faster. Therefore, the surface dry degree measured by the sensing device 200 may be greater for bedding than for clothing. For example, in case that the surface dry degree is measured after a lapse of a predetermined time from the start of the dry process, the surface dry degree in case of drying bedding may be greater than the surface dry degree in case of drying clothing. In general, bedding is bulky but light, the outer surface of bedding may be dried faster.

A graph 920 may indicate a change in overall dry degree of the subject to be dried over time. A table 910 may mean a change in surface dry degree of the subject to be dried, and a table 920 may mean a change in overall dry degree of the subject to be dried. In general, a dry time for bedding may be longer than that for clothing. Accordingly, in case that the overall dry degree of clothing and bedding is measured at a specific time point after the dry process starts, the overall dry degree of the clothing may be greater than the dry degree of the bedding.

Meanwhile, the sensing device 200 may include a contact-type electrode sensor. Then, the sensing device 200 may acquire a surface voltage value from the contact-type electrode sensor. Further, the sensing device 200 may transmit the acquired surface voltage value to the dry apparatus 100. Here, the dry apparatus 100 may identify whether or not a predetermined event occurs based on the acquired surface voltage value. Then, the dry apparatus 100 may calculate the number of times that the predetermined event occurs. Here, the predetermined event may mean that the surface voltage value decreases to a threshold rate. The higher the degree of wateriness is, the lower the surface voltage value.

A graph 930 may indicate a change in surface voltage value over time. The dry apparatus 100 may calculate the number of times that the surface voltage value is identified to be smaller than the third threshold value during a second threshold time (for example, 10 seconds). Times t3, t4, and t5 may be the same as the second threshold time. In time t3, the calculated number of times may be three times, in time t4, the calculated number of times may be two times, and in time t5, the calculated number of times may be one time.

A graph 940 may indicate a change in calculated number of times over time. For example, in case that the sensing device 200 is in contact with a watery subject to be dried, the surface voltage value may decrease. Therefore, at the start of the dry process, the number of times that the surface voltage value decreases to the threshold rate may be large, and the number of times that the surface voltage value decreases to the threshold rate may decrease as the subject to be dried is gradually dried. Here, the surface of bedding may be dried faster than the surface of clothing. Therefore, at a specific time point after the start of the dry process, the calculated number of times acquired in case of drying bedding may be smaller than the calculated number of times acquired in case of drying clothing.

Figure 10:
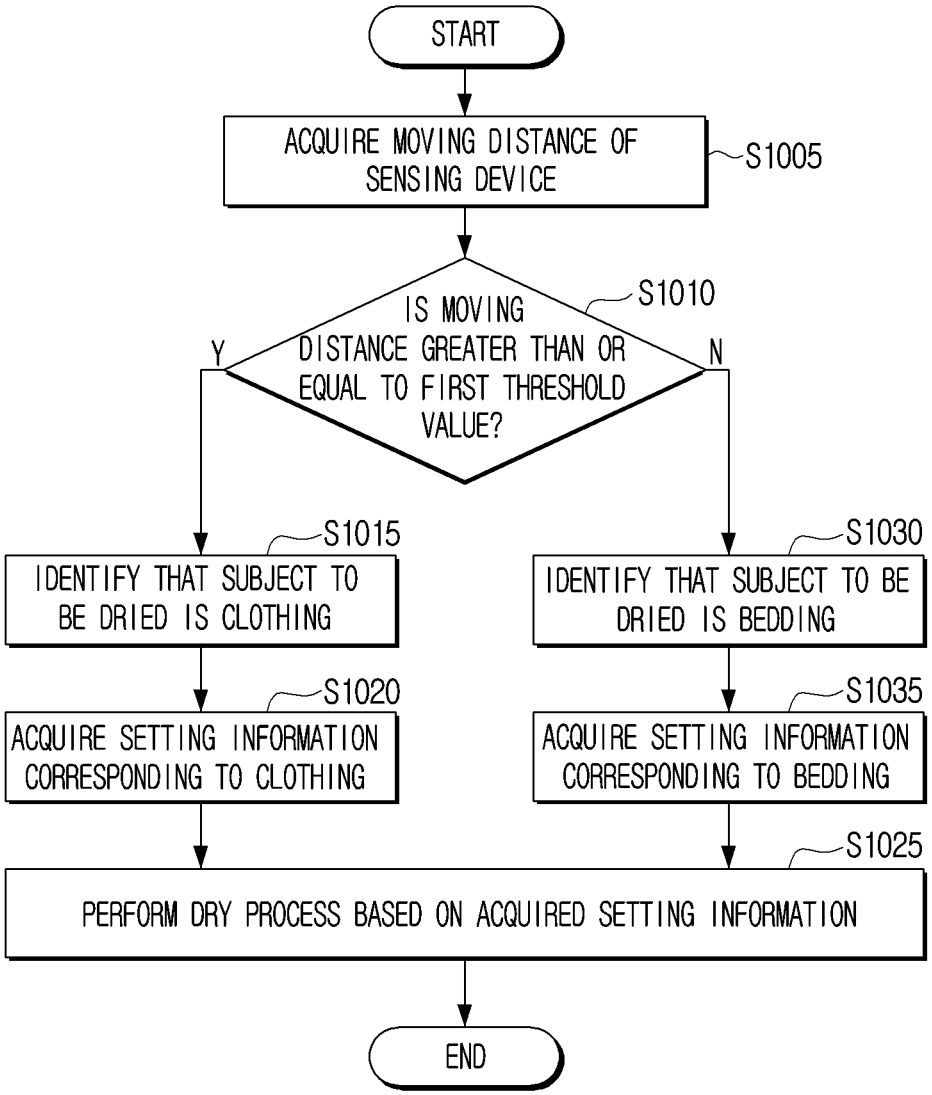
FIG. 10 is a flowchart illustrating an operation of determining the type of a subject to be dried by the dry apparatus according to one or more embodiments.

FIG. 10 is a flowchart illustrating an operation of determining the type of a subject to be dried by the dry apparatus according to one or more embodiments.

Referring to FIG. 10, the dry apparatus 100 may acquire the moving distance of the sensing device 200 at a specific time point (t2 in FIG. 8) (S1005). Then, the dry apparatus 100 may identify whether or not the moving distance is greater than or equal to the first threshold value (S1010). Here, in case that the moving distance is greater than or equal to the first threshold value, the dry apparatus 100 may identify that the subject to be dried is clothing (S1015). Then, the dry apparatus 100 may acquire setting information corresponding to the clothing (S1020). Then, the dry apparatus 100 may perform the dry process based on the acquired setting information (S1025). Here, the setting information may include at least one 430 of the dry time, the dry temperature, the strength of hot wind, or the rotating speed of the drum 122 of the dry apparatus 100.

Here, in case that the moving distance is smaller than the first threshold value, the dry apparatus 100 may identify that the subject to be dried is bedding (S1030). Then, the dry apparatus 100 may acquire setting information corresponding to the bedding (S1035). Then, the dry apparatus 100 may perform the dry process based on the acquired setting information (S1025).

Meanwhile, the operation of identifying the clothing or bedding (S1015 or S1030) may not necessarily be performed. The dry apparatus 100 may acquire the setting information based on the moving distance and the first threshold value and apply the acquired setting information to the dry process.

Here, in case that the cumulative moving distance smaller than or equal to the first threshold value of FIG. 8 is identified, the dry apparatus 100 may identify that the subject to be dried is bedding and a large amount of clothing. Therefore, a determination operation therefor will be described below with reference to FIG. 12.

Figure 11:
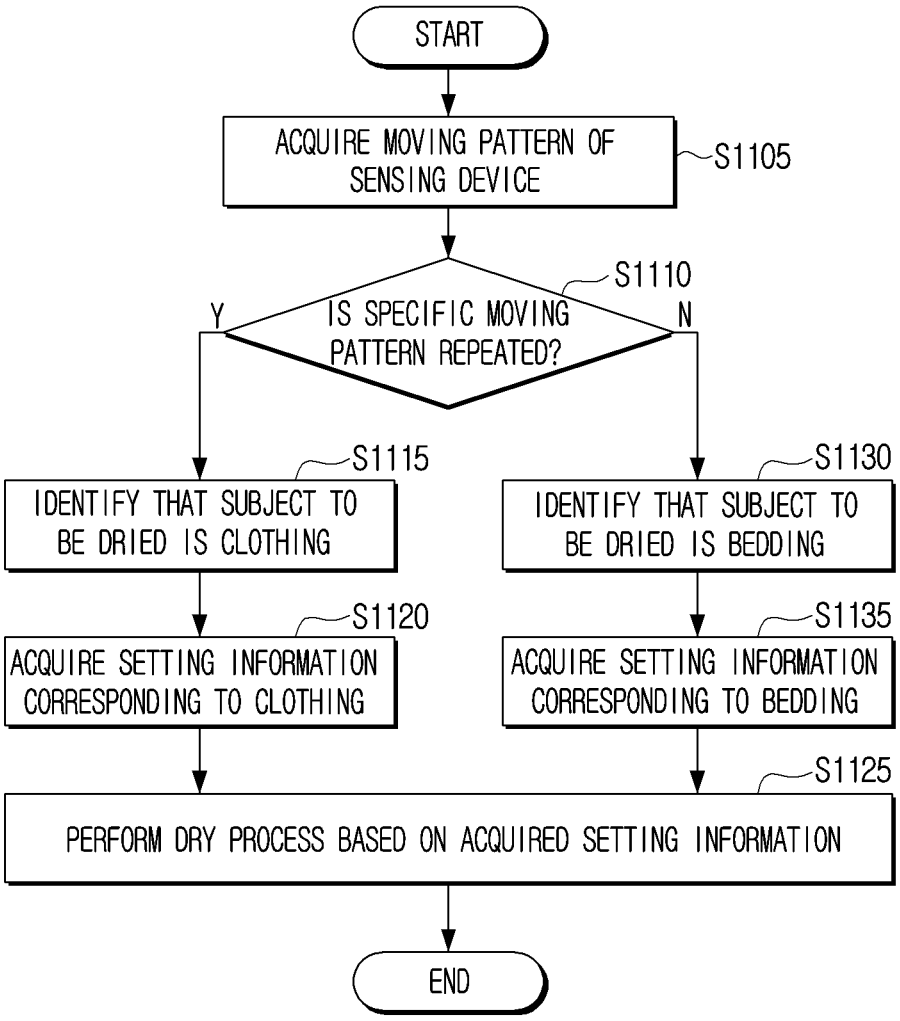
FIG. 11 is a flowchart illustrating an operation of determining the type of a subject to be dried by the dry apparatus according to other embodiments.

FIG. 11 is a flowchart illustrating an operation of determining the type of a subject to be dried by the dry apparatus according to other embodiments.

Referring to FIG. 11, the dry apparatus 100 may acquire the moving pattern of the sensing device 200 (S1105). Here, the moving pattern may mean a movement direction and a movement routine of the sensing device 200. The dry apparatus 100 may determine whether movement of the sensing device 200 is regular or irregular based on the moving pattern.

Here, the dry apparatus 100 may identify whether or not a specific moving pattern is repeated (S1110). Whether or not the specific moving pattern is repeated may be identified through the cumulative moving distance of the sensing device 200 or the harvester voltage. For example, the dry apparatus 100 may identify that the moving pattern is repeated in case that the cumulative moving distance constantly increases. In addition, the dry apparatus 100 may identify that the moving pattern is repeated in case that a variation of the harvester voltage value is regularly repeated.

In case that the specific moving pattern is repeated, the dry apparatus 100 may identify that the subject to be dried is clothing (S1115). Then, the dry apparatus 100 may acquire setting information corresponding to the clothing (S1120). Then, the dry apparatus 100 may perform the dry process based on the acquired setting information (S1125).

In case that the specific moving pattern is not repeated, the dry apparatus 100 may identify that the subject to be dried is bedding (S1130). Then, the dry apparatus 100 may acquire setting information corresponding to the bedding (S1135). Then, the dry apparatus 100 may perform the dry process based on the acquired setting information (S1125).

Meanwhile, the operation of identifying the clothing or bedding (S1115 or S1130) may not necessarily be performed. The dry apparatus 100 may acquire the setting information based on whether or not the moving pattern is repeated, and apply the acquired setting information to the dry process.

Figure 12:
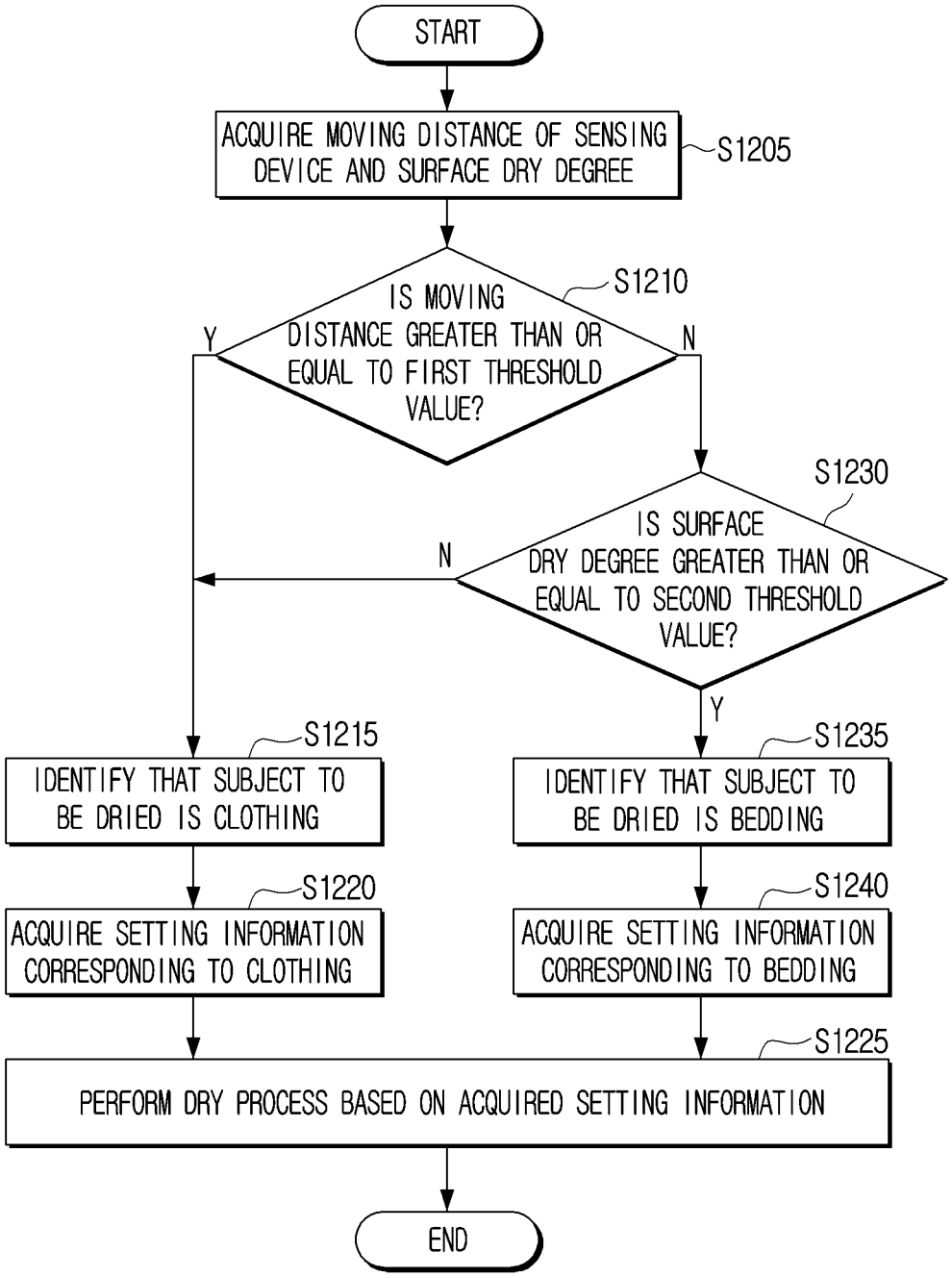
FIG. 12 is a flowchart illustrating an operation of determining the type of a subject to be dried by the dry apparatus according to other embodiments.

FIG. 12 is a flowchart illustrating an operation of determining the type of a subject to be dried by the dry apparatus according to other embodiments.

Referring to FIG. 12, the dry apparatus 100 may acquire the moving distance of the sensing device 200 at a specific time point (t2 in FIG. 8) (S1205). Then, the dry apparatus 100 may identify whether or not the moving distance is greater than or equal to the first threshold value (S1210). Here, in case that the moving distance is greater than or equal to the first threshold value, the dry apparatus 100 may identify that the subject to be dried is clothing (S1215). Then, the dry apparatus 100 may acquire setting information corresponding to the clothing (S1220). Then, the dry apparatus 100 may perform the dry process based on the acquired setting information (S1225).

Here, in case that the moving distance is smaller than the first threshold value, the dry apparatus 100 may identify whether or not the surface dry degree is greater than or equal to the second threshold value (S1230). In case that the surface dry degree is smaller than the second threshold value, the dry apparatus 100 may identify that the subject to be dried is clothing (S1215). Then, the dry apparatus 100 may perform steps S1220 and S1225.

In case that the surface dry degree is greater than or equal to the second threshold value, the dry apparatus 100 may identify that the subject to be dried is bedding (S1235). Then, the dry apparatus 100 may acquire setting information corresponding to the bedding (S1240). Then, the dry apparatus 100 may perform the dry process based on the acquired setting information (S1225).

Meanwhile, the operation of identifying the clothing or bedding (S1215 or S1235) may not necessarily be performed. The dry apparatus 100 may acquire the setting information based on the moving distance, the first threshold value, the surface dry degree, and the second threshold value and apply the acquired setting information to the dry process.

Figure 13:
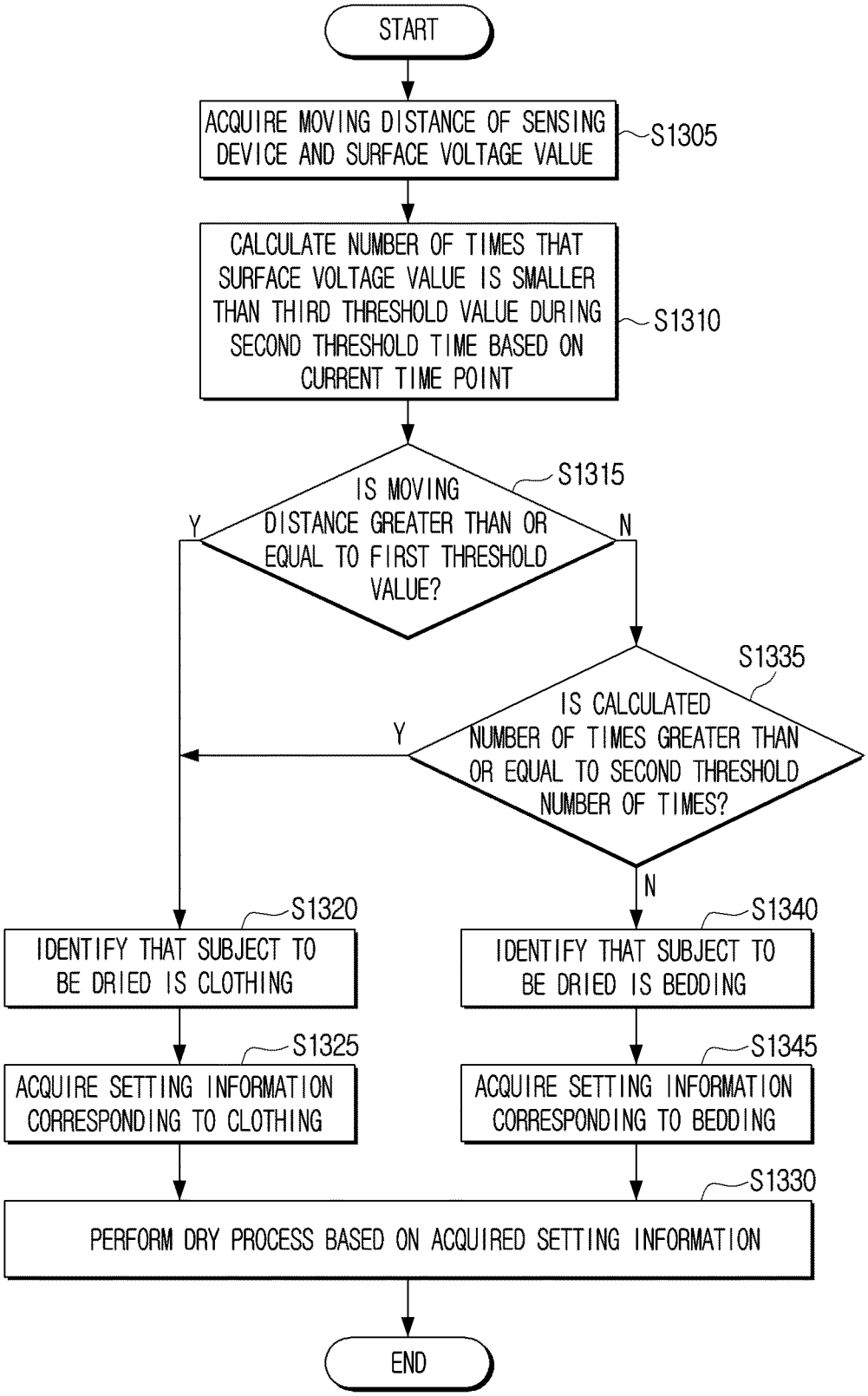
FIG. 13 is a flowchart illustrating an operation of determining the type of a subject to be dried by the dry apparatus according to other embodiments.

FIG. 13 is a flowchart illustrating an operation of determining the type of a subject to be dried by the dry apparatus according to other embodiments.

Referring to FIG. 13, the dry apparatus 100 may acquire the moving distance of the sensing device 200 (S1305). Further, the dry apparatus 100 may acquire the surface voltage of the sensing device 200 in real time. Then, the dry apparatus 100 may calculate the number of times that the surface voltage value of the sensing device 200 is smaller than the third threshold value during the second threshold time based on the current time point (S1310). In the graph 930 of FIG. 9, the number of times that the surface voltage value is smaller than the third threshold value during the second threshold time may be three times in time t3, two times in time t4, and one time in time t5.

Then, the dry apparatus 100 may identify whether or not the moving distance is greater than or equal to the first threshold value (S1315). Here, in case that the moving distance is greater than or equal to the first threshold value, the dry apparatus 100 may identify that the subject to be dried is clothing (S1320). Then, the dry apparatus 100 may acquire setting information corresponding to the clothing (S1325). Then, the dry apparatus 100 may perform the dry process based on the acquired setting information (S1330).

Here, in case that the moving distance is smaller than the first threshold value, the dry apparatus 100 may identify whether or not the calculated number of times is greater than or equal to a second threshold number of times (S1335). Here, in case that the calculated number of times is greater than or equal to the second threshold number of times, the dry apparatus 100 may identify that the subject to be dried is clothing (S1320). Then, the dry apparatus 100 may perform steps S1325 and S1330.

Here, in case that the calculated number of times is smaller than the second threshold number of times, the dry apparatus 100 may identify that the subject to be dried is bedding (S1340). Then, the dry apparatus 100 may acquire setting information corresponding to the bedding (S1345). Then, the dry apparatus 100 may perform the dry process based on the acquired setting information (S1330).

Meanwhile, the operation of identifying the clothing or bedding (S1320 or S1340) may not necessarily be performed. The dry apparatus 100 may acquire the setting information based on the moving distance, the first threshold value, the calculated number of times, and the second threshold number of times and apply the acquired setting information to the dry process.

Figure 14:
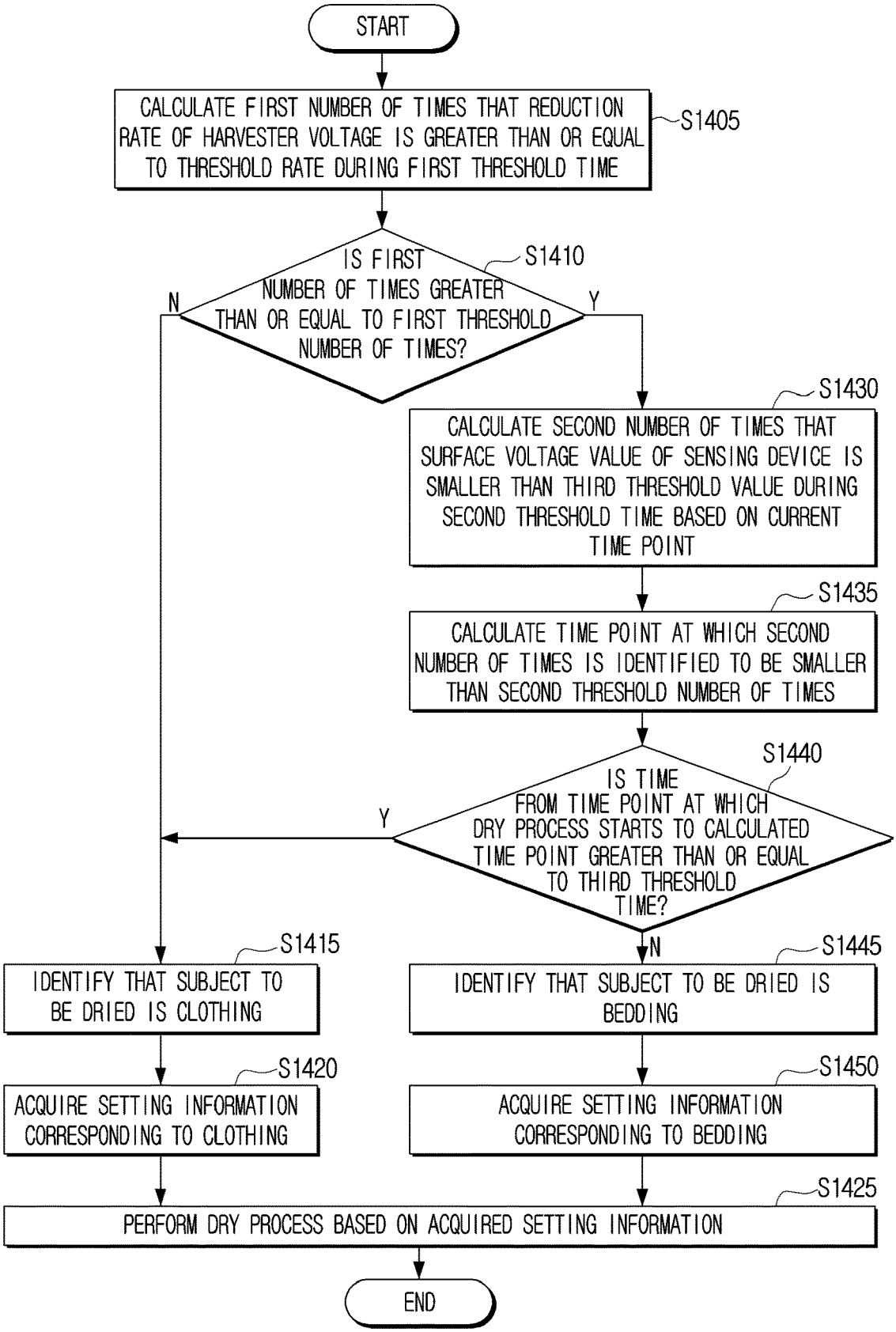
FIG. 14 is a flowchart illustrating an operation of determining the type of a subject to be dried by the dry apparatus according to other embodiments.

FIG. 14 is a flowchart illustrating an operation of determining the type of a subject to be dried by the dry apparatus according to other embodiments.

Referring to FIG. 14, the dry apparatus 100 may acquire a reduction rate of the harvester voltage during a first threshold time (t1–2). For example, in the graph 720 of FIG. 7, the harvester voltage may drop from 10 v to 5 v. Here, a reference harvester voltage may be 10 v. Further, the reduction rate of the harvester voltage may be 50% (the reference voltage is calculated as 10 v) because of the drop from 10 v to 5 v. The dry apparatus 100 may continuously calculate the reduction rate of the harvester voltage. The harvester voltage returns to the reference voltage, and thus, the dry apparatus 100 may acquire the reduction rate every time the harvester voltage returns to the reference voltage and drops to a value lower than the reference voltage.

The dry apparatus 100 may calculate a first number of times that the reduction rate of the harvester voltage is greater than or equal to a threshold rate during the first threshold time (t1–2) (S1405). Here, the threshold rate may mean 10%. Accordingly, the dry apparatus 100 may calculate the first number of times that the harvester voltage drops by 10% or more. In the graph 720 of FIG. 7, the first number of times that the harvester voltage drops by 10% or more may be two times.

The dry apparatus 100 may identify whether or not the first number of times is greater than or equal to a first threshold number of times (S1410). Here, in case that the first number of times is smaller than the first threshold number of times, the dry apparatus 100 may identify that the subject to be dried is clothing (S1415). Then, the dry apparatus 100 may acquire setting information corresponding to the clothing (S1425). Then, the dry apparatus 100 may perform the dry process based on the acquired setting information (S1430).

Here, in case that the first number of times is greater than or equal to the first threshold number of times, the dry apparatus 100 may calculate the second number of times that the surface voltage value of the sensing device 200 is smaller than the third threshold value during the second threshold time based on the current time point (S1430). Then, the dry apparatus 100 may calculate a time point at which the second number of times is identified to be smaller than the second threshold number of times (S1435). Then, the dry apparatus 100 may identify whether or not a time from a time point at which the dry process starts to the calculated time point is greater than or equal to a third threshold time (S1440). For example, in case of bedding in the graph 940 of FIG. 9, the time point at which the second number of times (the calculated number of times) is smaller than the second threshold number of times may be t6. Then, the dry apparatus 100 may identify that the time from the time point at which the dry process starts to the calculated time point is t6. Further, the dry apparatus 100 may identify whether or not the identified t6 is greater than or equal to the third threshold time. Here, the third threshold time (t7) may be predetermined according to a load, material, volume, and the like of the subject to be dried. The dry apparatus 100 may identify the type of the subject to be dried based on whether the identified t6 is greater than or equal to or is smaller than the third threshold time (t7).

In case that the time from the time point at which the dry process starts to the calculated time point is greater than or equal to the third threshold time, the dry apparatus 100 may identify that the subject to be dried is clothing (S1415). Then, the dry apparatus 100 may perform steps S1420 and S1425.

In case that the time from the time point at which the dry process starts to the calculated time point is smaller than the third threshold time, the dry apparatus 100 may identify that the subject to be dried is bedding (S1445). Then, the dry apparatus 100 may acquire setting information corresponding to the bedding (S1450). Then, the dry apparatus 100 may perform the dry process based on the acquired setting information (S1425).

Meanwhile, the operation of identifying the clothing or bedding (S1415 or S1445) may not necessarily be performed. The dry apparatus 100 may acquire the setting information based on the first number of times, the first threshold number of times, the second number of times, the second threshold number of times, the time from the time point at which the dry process starts to the calculated time point, and the third threshold time, and apply the acquired setting information to the dry process.

Figure 15:
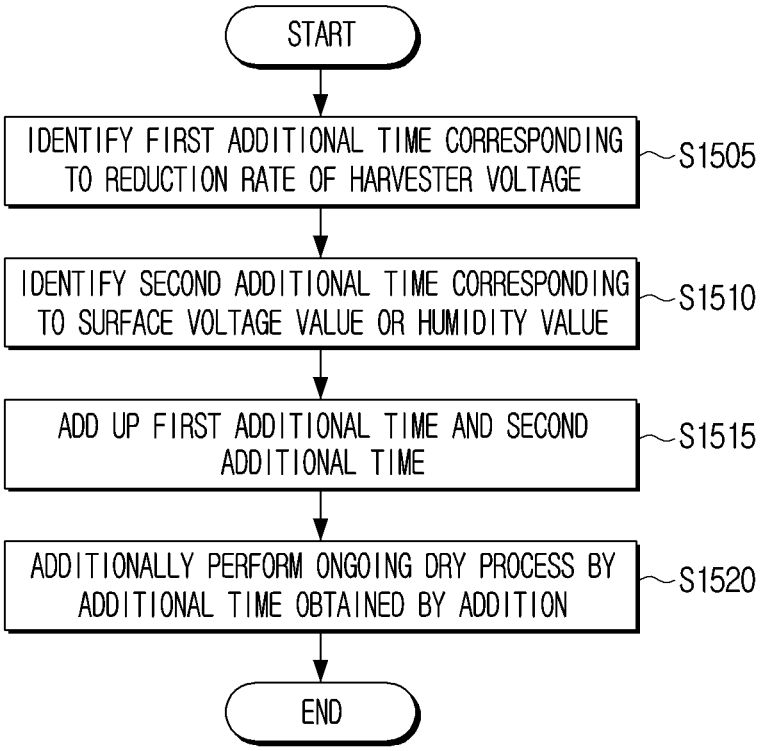
FIG. 15 is a flowchart for illustrating an operation of granting an additional time to the ongoing dry process according to an embodiment of the present disclosure.

FIG. 15 is a flowchart for illustrating an operation of granting an additional time to the ongoing dry process.

Referring to FIG. 15, the dry apparatus 100 may identify a first additional time corresponding to the reduction rate of the harvester voltage (S1505). The dry apparatus 100 may acquire the reduction rate of the harvester voltage based on a table 1620 of FIG. 16. A large reduction rate may mean that the harvester voltage is significantly reduced. Therefore, the larger the reduction rate, the more the additional time may be required. A significant reduction in harvester voltage may mean that the subject to be dried corresponds to bedding or the volume of clothing is large.

Then, the dry apparatus 100 may identify a second additional time corresponding to at least one of a surface voltage value or a humidity value (S1510). The dry apparatus 100 may acquire the second additional time corresponding to at least one of the surface voltage value or the humidity value based on a table 1630 of FIG. 16. The surface voltage value may mean the surface dry degree, and the humidity value may mean the humidity value inside the drum 122. The waterier the surface of the subject to be dried or the inside of the drum 122, the longer the additional dry time may be required.

Then, the dry apparatus 100 may add up the first additional time and the second additional time (S1515). Then, the dry apparatus 100 may additionally perform the ongoing dry process by the additional time obtained by the addition (S1520). For example, in case that an original time for which the dry process is to be performed is one hour, the dry apparatus 100 may change the dry time in such a way that the dry process is performed for a total of one hour and 30 minutes by adding an additional time of 30 minutes to the original time of one hour.

FIG. 16 is a table for illustrating information used to identify the additional time for the dry process.

Referring to FIG. 16, a table 1610 may indicate a reference harvester voltage and a threshold rate for a plurality of sections. In the table 1610, the same reference harvester voltage and threshold rate are described for the plurality of sections. Depending on implementation examples, different reference harvester voltages and threshold rates may be applied for the plurality of sections. According to the table 1610, the reference harvester voltage may be 5.3 V and the threshold rate may be 10%. Accordingly, the dry apparatus 100 may calculate the number of times that the harvester voltage is reduced by 10% (0.53 V) or more based on the reference voltage of 5.3 V for T minutes as the first threshold time in step S1405.

The table 1620 may indicate the additional time according to the reduction rate. For example, it is assumed that the harvester voltage is reduced from 10 V to 5 V in the table 720 of FIG. 7. The dry apparatus 100 may acquire 50% as the reduction rate. Then, the dry apparatus 100 may identify that the first additional time is 80 minutes based on the table 1620.

The table 1630 may indicate the additional time corresponding to at least one of the surface voltage value or the humidity value. The smaller the surface voltage value or the greater the humidity value, the longer the additional dry time may be required.

Figure 17:
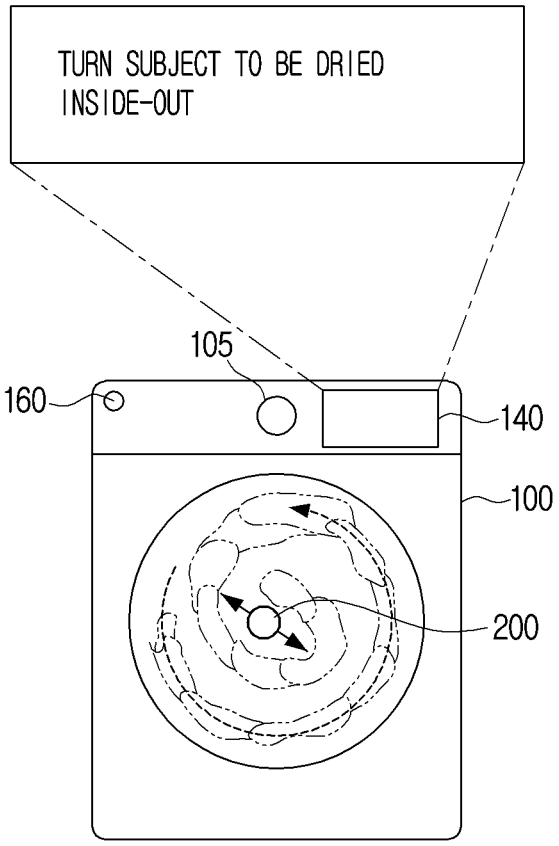
FIG. 17 is a diagram for illustrating an example of guiding a user to perform a specific action according to an embodiment of the present disclosure.

FIG. 17 is a diagram for illustrating an example of guiding the user to perform a specific action.

Referring to FIG. 17, the dry apparatus 100 may include a user interface 105, a display 140, and a speaker 160.

Here, the dry apparatus 100 may acquire the surface dry degree. The user may expect that the subject to be dried is completely dried to the inside after a predetermined time elapses from the start of the dry process. Here, the dry apparatus 100 may measure the surface dry degree through the sensing device 200. The dry apparatus 100 may measure the surface dry degree at a time point immediately before the dry process is completed (for example, five minutes before the completion of the dry process). Further, in case that the surface dry degree is smaller than the threshold value, the dry apparatus 100 may determine that the subject to be dried is not completely dried. In addition, the dry apparatus 100 may provide guide information to the user.

In general, a bulky subject to be dried such as bedding may not be dried to the inside. Therefore, the dry apparatus 100 may not dry a subject to be dried to the inside even in case of additionally drying the subject to be dried for the additional time. Therefore, the dry apparatus 100 may output the guide information. Here, the guide information may include a request to turn the subject to be dried inside-out.

As an example, the dry apparatus 100 may display the guide information in the form of text data or image data through the display 140 included in the dry apparatus 100. As another example, the dry apparatus 100 may display the guide information in the form of audio data through the speaker 160 included in the dry apparatus 100.

Figure 18:
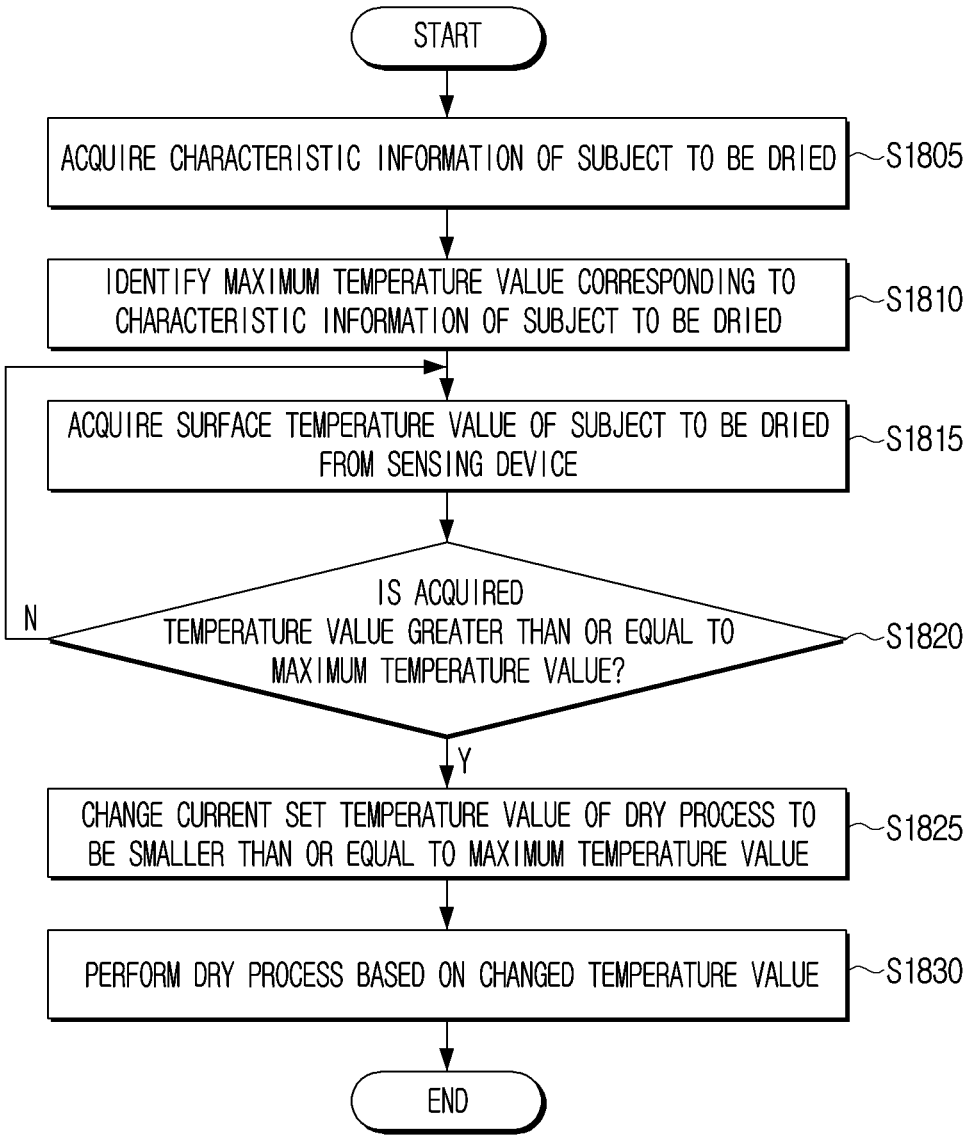
FIG. 18 is a flowchart for illustrating an operation of changing setting information corresponding to the dry process according to one or more embodiments.

FIG. 18 is a flowchart illustrating an operation of changing setting information corresponding to the dry process according to one or more embodiments.

Referring to FIG. 18, the dry apparatus 100 may acquire characteristic information of a subject to be dried (S1805). Then, the dry apparatus 100 may identify a maximum temperature value corresponding to the characteristic information of the subject to be dried (S1810). Here, the maximum temperature value may mean an allowable maximum temperature at which the subject to be dried is not damaged. The maximum temperature value may vary depending on the type of the subject to be dried. For example, the maximum temperature value for synthetic fiber may be 70 degrees, and the maximum temperature value for cotton may be 50 degrees.

Then, the dry apparatus 100 may acquire a surface temperature value of the subject to be dried from the sensing device 200 (S1815). Then, the dry apparatus 100 may identify whether or not the acquired temperature value is greater than or equal to the maximum temperature value (S1820).

In case that the acquired temperature value is smaller than the maximum temperature value, the dry apparatus 100 may repeat steps S1815 and S1820. In case that the acquired temperature value is greater than or equal to the maximum temperature value, the dry apparatus 100 may change a current set temperature value of the dry process to be smaller than or equal to the maximum temperature value (S1825). Then, the dry apparatus 100 may perform the dry process based on the changed temperature value (S1830).

Figure 19:
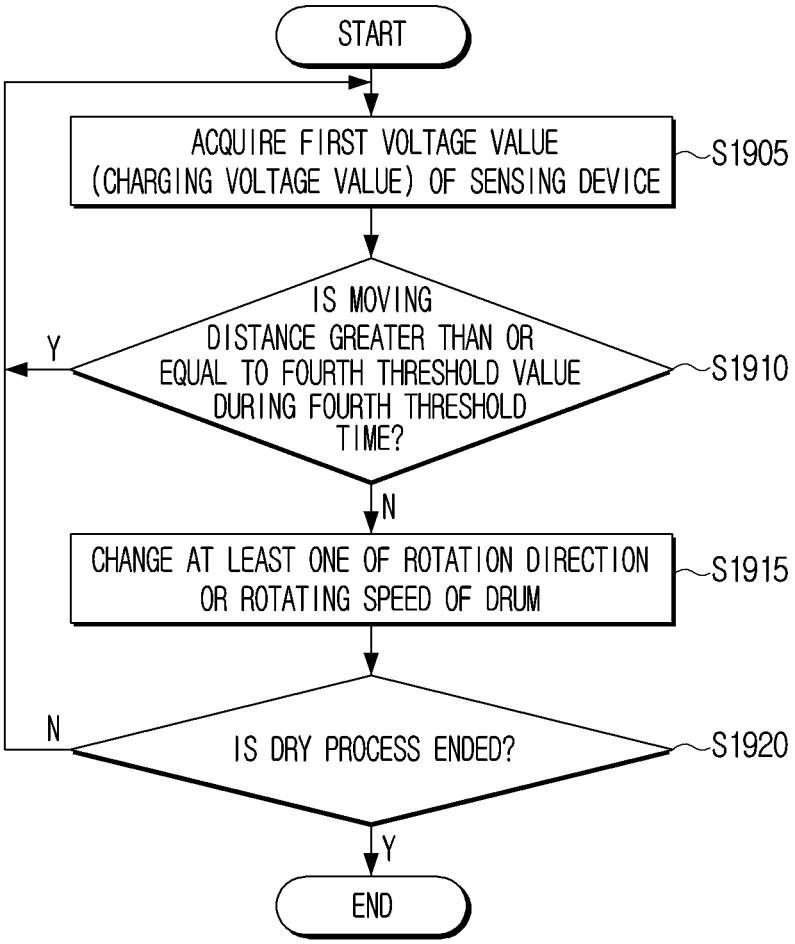
FIG. 19 is a flowchart for illustrating an operation of changing the setting information corresponding to the dry process according to other embodiments.

FIG. 19 is a flowchart for illustrating an operation of changing the setting information corresponding to the dry process according to other embodiments.

Referring to FIG. 19, the dry apparatus 100 may acquire moving distance information of the sensing device 200 (S1905). Then, the dry apparatus 100 may identify whether or not the moving distance is greater than or equal to a fourth threshold value during a fourth threshold time (S1910). Here, in case that the moving distance is greater than or equal to the fourth threshold value during the fourth threshold time, the dry apparatus 100 may repeat steps S1905 and S1910.

Here, in case that the moving distance is smaller than the fourth threshold value during the fourth threshold time, the dry apparatus 100 may change at least one of a rotation direction or the rotating speed of the drum 122 (S1915). In case that the moving distance is small, the dry apparatus 100 may determine that the sensing device 200 is hung at a specific position. Accordingly, the dry apparatus 100 may change the rotation direction or the rotating speed of the drum 122 in such a way that the sensing device 200 may freely move.

Then, the dry apparatus 100 may determine whether or not the dry process is ended (S1920). In case that the dry process is not ended, the dry apparatus 100 may repeat steps S1905, S1910, S1915, and S1920.

Figure 20:
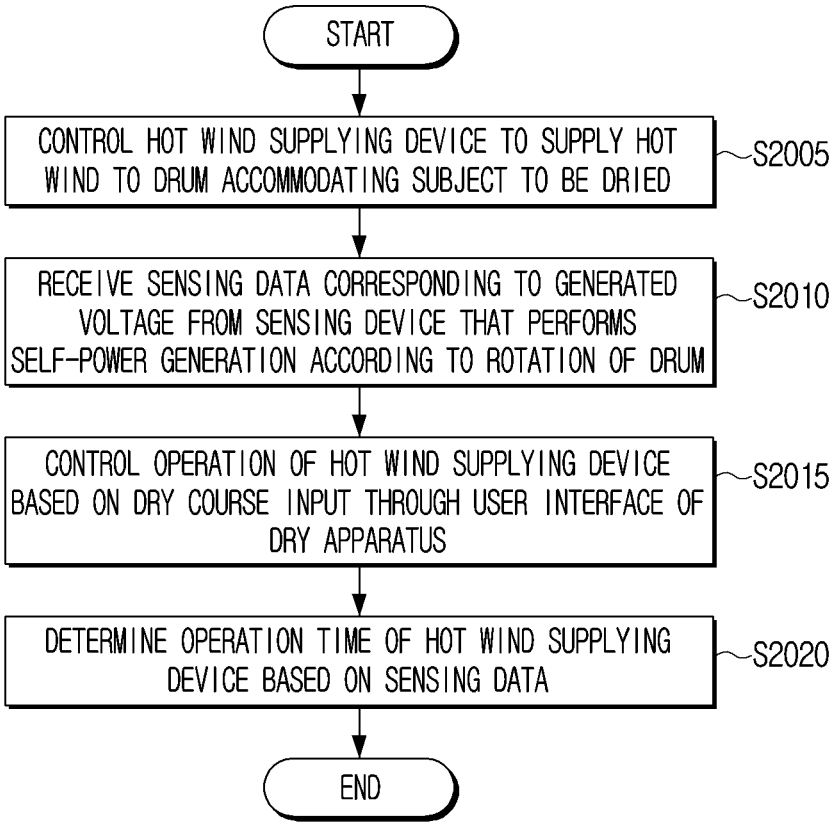
FIG. 20 is a flowchart illustrating a control method of the dry apparatus according to one or more embodiments.

FIG. 20 is a flowchart illustrating a control method of the dry apparatus according to one or more embodiments.

Referring to FIG. 20, the control method of the dry apparatus 100 according to one or more embodiments of the disclosure includes controlling the hot wind supplying device 124 to supply hot wind to the drum 122 accommodating a subject to be dried (S2005), receiving sensing data corresponding to a generated voltage from the sensing device 200 that performs self-power generation according to rotation of the drum 122 (S2010), and controlling an operation of the hot wind supplying device 124 based on a dry course input through the user interface 105 of the dry apparatus 100 (S2015), and in the controlling of the operation of the hot wind supplying device 124, an operation time of the hot wind supplying device 124 is determined based on the sensing data (S2020).

Meanwhile, the sensing data may include at least one of humidity or temperature.

The sensing device 200 may move along with a subject to be dried accommodated in the drum 122 by rotation of the drum 122 and may be connected to the communication interface 110 of the dry apparatus 100 through wireless communication.

Meanwhile, in the controlling of the operation of the hot wind supplying device 124, a voltage variation range may be acquired through the sensing data and the operation time may be determined based on the acquired voltage variation range.

Meanwhile, in the controlling of the operation of the hot wind supplying device 124 (S2015), the rotating operation of the drum 122 may be controlled, and the operation time may be determined based on the sensing data acquired for a certain period of time from the time point at which the drum 122 is controlled to rotate.

Meanwhile, in the controlling of the operation of the hot wind supplying device 124 (S2015), the operation time of the hot wind supplying device 124 may be determined as the first time based on the dry course, the operation time of the hot wind supplying device 124 may be determined as the second time based on the sensing data, and the second time may be greater than the first time.

Meanwhile, in the controlling of the operation of the hot wind supplying device 124 (S2015), the operation time may be changed based on humidity or temperature while controlling the operation of the hot wind supplying device 124 according to the operation time.

Meanwhile, the control method may further include receiving a signal corresponding to the dry degree of the subject to be dried from the dry degree sensor of the sensing device 200 contacting the subject to be dried accommodated in the drum 122, the sensing data may include humidity data, and in the controlling of the operation of the hot wind supplying device 124 (S2015), whether to operate the hot wind supplying device 124 based on the humidity data acquired after a time point determined based on the signal transmitted from the dry degree sensor.

Meanwhile, in the controlling of the operation of the hot wind supplying device 124 (S2015), an operation of the heat pump device of the hot wind supplying device 124 that heats air by using condensed heat of the refrigerant may be controlled based on the operation time.

Meanwhile, in the controlling of the operation of the hot wind supplying device 124 (S2015), the hot wind supplying device 124 may be controlled based on setting information corresponding to the voltage, and the setting information corresponding to the voltage may include at least one of the dry time, the dry temperature, the strength of hot wind, or the rotating speed of the drum 122.

Meanwhile, the control method of the dry apparatus 100 as illustrated in FIG. 20 may be executed on the dry apparatus having the configuration of FIG. 1 or 2 or may be executed on dry apparatuses having other configurations.

Meanwhile, the methods according to various embodiments of the disclosure described above may be implemented in the form of an application that may be installed in the dry apparatus.

In addition, the methods according to various embodiments of the disclosure described above may be implemented only by software upgrade or hardware upgrade for the dry apparatus.

In addition, various embodiments of the disclosure described above may also be implemented through an embedded server provided in the dry apparatus or a server disposed outside the dry apparatus.

Meanwhile, according to one or more embodiments of the disclosure, the diverse embodiments described above may be implemented by software including instructions stored in a machine-readable storage medium (for example, a computer-readable storage medium). A machine may be an apparatus that invokes the stored instruction from the storage medium and may operate according to the invoked instruction, and may include the dry apparatus according to the disclosed embodiments. In case that a command is executed by the processor, the processor may directly perform a function corresponding to the command or other components may perform the function corresponding to the command under a control of the processor. The command may include codes created or executed by a compiler or an interpreter. The machine-readable storage medium may be provided in the form of a non-transitory storage medium. Here, the term "non-transitory" means that the storage medium is tangible without including a signal, and does not distinguish whether data are semi-permanently or temporarily stored in the storage medium.

Further, according to one or more embodiments of the disclosure, the methods according to various embodiments described above may be included and provided in a computer program product. The computer program product may be traded as a product between a seller and a purchaser. The computer program product may be distributed in the form of a storage medium (e.g., a compact disc read only memory (CD-ROM)) that may be read by the machine or online through an application store (e.g., PlayStore™). In case of online distribution, at least a part of the computer program product may be temporarily stored in a storage medium such as a server of a manufacturer, a server of an application store, or a memory of a relay server, or temporarily created.

In addition, each of components (e.g., modules or programs) according to the diverse embodiments described above may include a single entity or a plurality of entities, and some of the corresponding sub-components described above may be omitted or other sub-components may be further included in the diverse embodiments. Alternatively or additionally, some of the components (e.g., the modules or the programs) may be integrated into one entity, and may perform functions performed by the respective corresponding components before being integrated in the same or similar manner. Operations performed by the modules, the programs, or other components according to the diverse embodiments may be executed in a sequential manner, a parallel manner, an iterative manner, or a heuristic manner, at least some of the operations may be performed in a different order or be omitted, or other operations may be added.

Although embodiments of the disclosure have been illustrated and described hereinabove, the disclosure is not limited to the abovementioned specific embodiments, but may be variously modified by those skilled in the art to which the disclosure pertains without departing from the gist of the disclosure as disclosed in the accompanying claims. These modifications should also be understood to fall within the scope and spirit of the disclosure.

What is claimed is:

1. A dry apparatus comprising:

a user interface configured to receive input for a dry course to be performed;

a communication interface;

a drum configured to accommodate a subject to be dried;

a hot wind supplying device configured to supply hot air to the drum in association with the dry course to dry the subject while the subject is accommodated in drum;

a sensing device configured to perform self-power generation based on a movement of the sensing device inside the drum while the drum is being rotated in association with the dry course to dry the subject accommodated in drum and transmit sensing data corresponding to a voltage generated according to the self-power generation to the communication interface; and a processor configured to:

control an operation of the hot wind supplying device based on the input for the dry course received through the user interface, and wherein the control of the operation of the hot wind supplying device by the processor includes determining an operation time during which the hot wind supplying device operates to supply the hot air to the drum based on the sensing data.

2. The dry apparatus as claimed in claim 1, wherein the sensing data includes at least one of humidity or temperature.

3. The dry apparatus as claimed in claim 1, wherein the sensing device moves along with the subject to be dried accommodated in the drum while the drum is being rotated and the sensing device is connectable to communicate with the communication interface through wireless communication.

4. The dry apparatus as claimed in claim 1, wherein the processor is configured to acquire a voltage variation range through the sensing data and determine the operation time based on the acquired voltage variation range.

5. The dry apparatus as claimed in claim 1, wherein the processor is configured to control a rotating operation of the drum and determine the operation time of the hot wind supplying device based on the sensing data acquired for a certain period of time from a time point at which the drum is controlled to rotate.

6. The dry apparatus as claimed in claim 5, wherein the processor is configured to determine the operation time of the hot wind supplying device as a first time based on the dry course and determine the operation time of the hot wind supplying device as a second time based on the sensing data, and the second time is greater than the first time.

7. The dry apparatus as claimed in claim 2, wherein the processor is configured to change the operation time of the hot wind supplying device based on humidity or temperature while controlling the operation of the hot wind supplying device according to the operation time.

8. The dry apparatus as claimed in claim 1, wherein the processor is configured to receive a signal corresponding to a dry degree of the subject to be dried from a dry degree sensor of the sensing device in contact with the subject to be dried accommodated in the drum, the sensing data includes humidity data, and the processor is configured to determine whether to operate the hot wind supplying device based on the humidity data acquired after a time point that was determined based on the signal transmitted from the dry degree sensor.

9. The dry apparatus as claimed in claim 1, wherein the hot wind supplying device includes a heat pump device that heats air by using condensed heat of a refrigerant and a blowing device, and the processor is configured to control an operation of the heat pump device based on the operation time of the hot wind supplying device.

10. The dry apparatus as claimed in claim 1, wherein the processor is configured to control the hot wind supplying device based on setting information corresponding to the voltage, and the setting information corresponding to the voltage includes at least one of a dry time, a dry temperature, a strength of hot wind, or a rotating speed of the drum.

11. A control method of a dry apparatus, the control method comprising:

controlling a hot wind supplying device to supply hot air to a drum which accommodates a subject to be dried;

receiving sensing data corresponding to a voltage generated from a sensing device that performs self-power generation based on a movement of the sensing device inside the drum while the drum is being rotated in association with an input for a dry course to dry the subject accommodated in drum; and controlling an operation of the hot wind supplying device based on the input for the dry course through a user interface of the dry apparatus, wherein in the controlling of the operation of the hot wind supplying device, an operation time during which the hot wind supplying device operates to supply the hot air to the drum is determined based on the sensing data.

12. The control method as claimed in claim 11, wherein the sensing data includes at least one of humidity or temperature.

13. The control method as claimed in claim 11, wherein the sensing device moves along with the subject to be dried accommodated in the drum while the drum is being rotated and the sensing device is connectable to communicate with a communication interface of the dry apparatus through wireless communication.

14. The control method as claimed in claim 11, wherein in the controlling of the operation of the hot wind supplying device, a voltage variation range is acquired through the sensing data, and the operation time is determined based on the acquired voltage variation range.

15. The control method as claimed in claim 11, wherein in the controlling of the operation of the hot wind supplying device, a rotating operation of the drum is controlled, and the operation time of the hot wind supplying device is determined based on the sensing data acquired for a certain period of time from a time point at which the drum is controlled to rotate.

* * * * *